US010633203B2

(12) United States Patent
Furumoto et al.

(10) Patent No.: US 10,633,203 B2
(45) Date of Patent: Apr. 28, 2020

(54) SHEET ACCOMMODATING DEVICE AND IMAGE FORMING APPARATUS INCLUDING THE SAME

(71) Applicant: SHARP KABUSHIKI KAISHA, Sakai, Osaka (JP)

(72) Inventors: Haruhisa Furumoto, Sakai (JP); Kohji Aoki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/177,442

(22) Filed: Nov. 1, 2018

(65) Prior Publication Data

US 2019/0127162 A1 May 2, 2019

(30) Foreign Application Priority Data

Nov. 1, 2017 (JP) ..... 2017-212003

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2402/5151* (2013.01); *B65H 2403/41* (2013.01); *B65H 2403/533* (2013.01); *B65H 2511/10* (2013.01); *B65H 2511/20* (2013.01)

(58) Field of Classification Search
CPC .. B65H 1/266; B65H 1/04; B65H 2402/5151; B65H 2511/11; B65H 2511/12; B65H 2511/10; B65H 2405/112; B65H 2405/1122
See application file for complete search history.

(56) References Cited

U.S. PATENT DOCUMENTS 6,926,269 B2 * 8/2005 Ishikuro ..... B65H 1/04 271/171
7,922,171 B2 * 4/2011 Kawamura ..... B65H 1/26 271/145
9,199,808 B2 * 12/2015 Shiokawa ..... B65H 1/266
(Continued)

FOREIGN PATENT DOCUMENTS

JP H09-240847 A 9/1997
JP 2000229732 A * 8/2000
JP 2010052910 A * 3/2010

*Primary Examiner* — Luis A Gonzalez
(74) *Attorney, Agent, or Firm* — ScienBiziP, P.C.

(57) ABSTRACT

A sheet accommodating device includes a regulating member that regulates end portions of sheets and a moving member movably provided in a body of the sheet accommodating device. The regulating member is detachably provided on the moving member. A moving region of the moving member includes a size regulation region where the end portions of the sheets are regulated and a predetermined non-size regulation region excluding the size regulation region. The sheet accommodating device is configured to permit the regulating member to be attached to and detached from the moving member in a predetermined attaching and detaching position of the non-size regulation region and prohibit the regulating member from being detached from the moving member in a detachment prohibition region of the moving region excluding the attaching and detaching position.

13 Claims, 22 Drawing Sheets

(56) References Cited

U.S. PATENT DOCUMENTS

| | | | | |
|---|---|---|---|---|
| 2009/0295073 | A1* | 12/2009 | Furusawa | B65H 1/266 271/171 |
| 2012/0061907 | A1* | 3/2012 | Matsuyama | B65H 1/266 271/145 |
| 2015/0076763 | A1* | 3/2015 | Katsura | B65H 7/02 271/227 |
| 2015/0084274 | A1* | 3/2015 | Kotaka | B65H 1/04 271/253 |
| 2018/0056680 | A1* | 3/2018 | Daigo | B41J 13/0036 |

* cited by examiner

SHEET ACCOMMODATING DEVICE AND IMAGE FORMING APPARATUS INCLUDING THE SAME

BACKGROUND

1. Field

The present disclosure relates to a sheet accommodating device and an image forming apparatus, such as a copier, an MFP, a printer, or a facsimile apparatus, including the same.

2. Description of the Related Art

In general, an image forming apparatus includes a sheet accommodating device (or more specifically, a paper feed cassette or a paper feed tray) that accommodates sheets such as recording paper, and in performing an image forming operation, the sheets accommodated in the sheet accommodating device are fed one by one from the sheet accommodating device to an image forming apparatus body for image formation in the image forming apparatus body.

Some sheet accommodating device includes a regulating member (or more specifically, width regulating members and/or a rear-end regulating member) that regulates end portions of sheets. Note here that the width regulating members regulate, in a first direction, both end portions of the sheets in the first direction extending along a sheet surface orthogonal to a sheet feed direction. The rear-end regulating member regulates, in a second direction, rear-end portions of the sheets in the second direction extending along the sheet feed direction. From a point of view of downsizing of a sheet accommodating device, there has been known such a sheet accommodating device that a regulating member is attachable to and detachable from a body of the sheet accommodating device, and in a case where sheets of a maximum accommodatable size are accommodated, a wall surface of the body of a sheet feeding device is utilized as the regulating member with the regulating member detached (see, for example, Japanese Unexamined Patent Application Publication No. 9-240847).

However, since the configuration described in Japanese Unexamined Patent Application Publication No. 9-240847 is a configuration in which the regulating member is attached and detached for each size of sheets, the sheet accommodating device ends up being limited in size of sheets and cannot handle sheets of any size that is equal to or smaller than the maximum accommodatable size. For example, the sheet accommodating device has difficulty in handling both centimeter specifications and inch specifications. Further, since the regulating member is attached and detached in each size position, an operator such as a user may detach the regulating member even when he/she does not intend to do so (i.e. by mistake).

It is desirable to provide a sheet accommodating device including a regulating member that regulates end portions of sheets and an image forming apparatus which make it possible, even with a configuration in which the regulating member is attached and detached, to handle sheets of any size that is equal to or smaller than a maximum accommodatable size and which allow an operator such as a user to avoid detaching the regulating member even when he/she does not intend to detach the regulating member.

SUMMARY

According to an aspect of the disclosure, there is provided a sheet accommodating device including: a regulating member that regulates end portions of sheets; and a moving member movably provided in a body of the sheet accommodating device, wherein the regulating member is detachably provided on the moving member, and a moving region of the moving member includes a size regulation region where the end portions of the sheets are regulated and a predetermined non-size regulation region excluding the size regulation region, the sheet accommodating device being configured to permit the regulating member to be attached to and detached from the moving member in a predetermined attaching and detaching position of the non-size regulation region and prohibit the regulating member from being detached from the moving member in a detachment prohibition region of the moving region excluding the attaching and detaching position. Further, according to an aspect of the disclosure, there is provided an image forming apparatus including the sheet accommodating device according to the foregoing aspect of the present disclosure.

DESCRIPTION OF THE EMBODIMENTS

An embodiment of the present disclosure is described below with reference to the drawings.

Overall Configuration of Image Forming Apparatus

Figure 1:
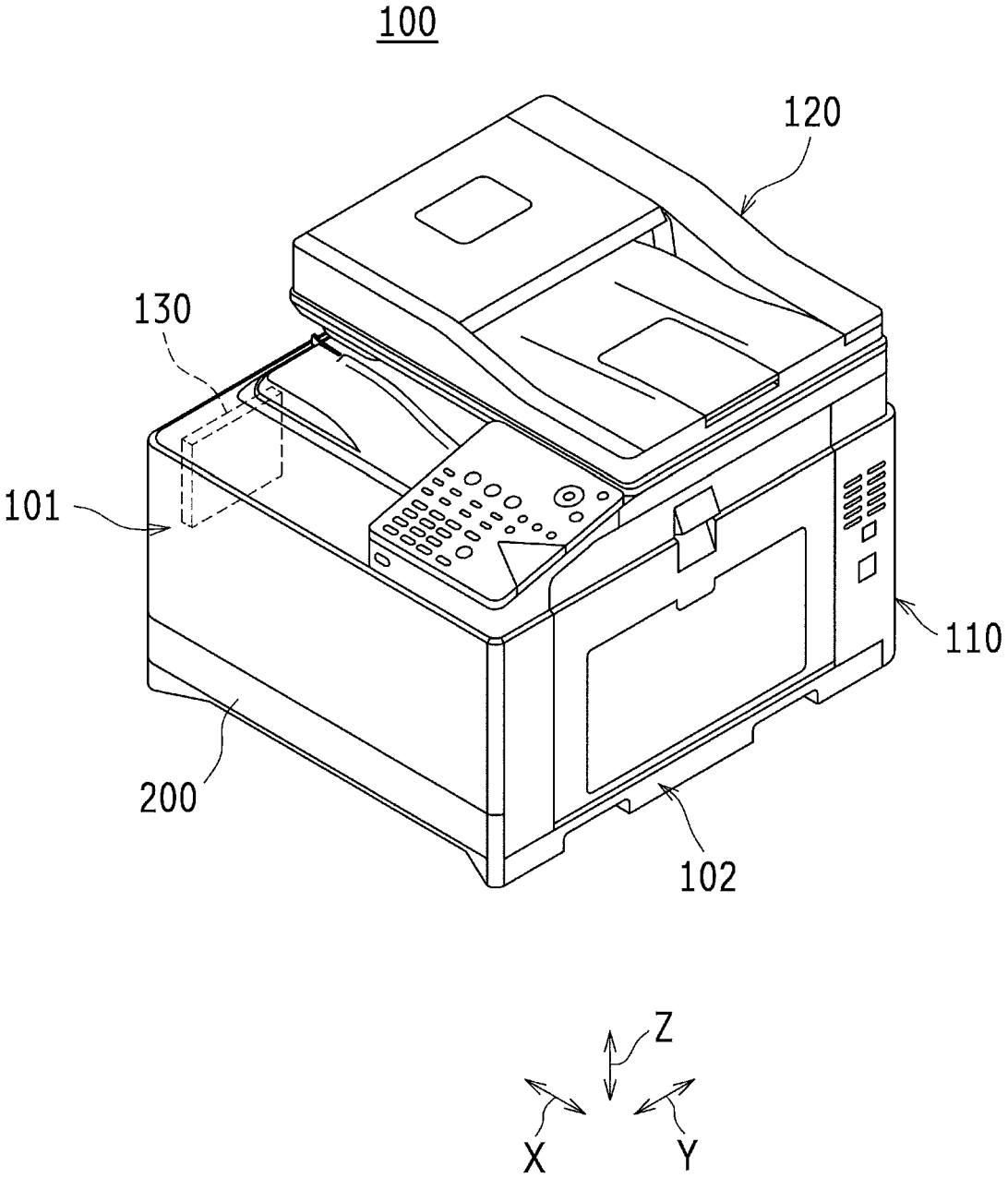
FIG. 1 is a perspective view showing an appearance of an image forming apparatus according to the present embodiment.

FIG. 1 is a perspective view showing an appearance of an image forming apparatus 100 according to the present embodiment. In FIG. 1, the sings X, Y, and Z denote a horizontal direction, a depth direction, and a vertical direction, respectively, of the image forming apparatus 100.

The image forming apparatus 100 shown in FIG. 1 is an image forming apparatus, including an image carrier (or more specifically, a photosensitive drum; not illustrated), that forms an image on a sheet (or more specifically, a recording sheet) such as recording paper (not illustrated) in accordance with image data transmitted from an outside source. The imaging forming apparatus 100 may be a monochrome image forming apparatus or a color image forming apparatus (e.g. a tandem color image forming apparatus).

The image forming apparatus 100 includes an image forming apparatus body 110 and an image reading device 120. The image forming apparatus body 110 is provided with an image forming unit 101 and a sheet conveyance system 102.

The image forming apparatus 100 includes a sheet accommodating device 200 (or more specifically, a paper feed cassette or a paper feed tray) that accommodates sheets. The image forming apparatus 100 is configured such that in performing an image forming operation, the sheets accommodated in the sheet accommodating device 200 are fed one by one from the sheet accommodating device 200 to the image forming apparatus body 110 by a sheet feeding member (or more specifically, a pickup roller 271; not illustrated in FIG. 1; see FIGS. 2 and 18 described below) for image formation in the image forming apparatus body 110.

Sheet Accommodating Device

Figure 2:
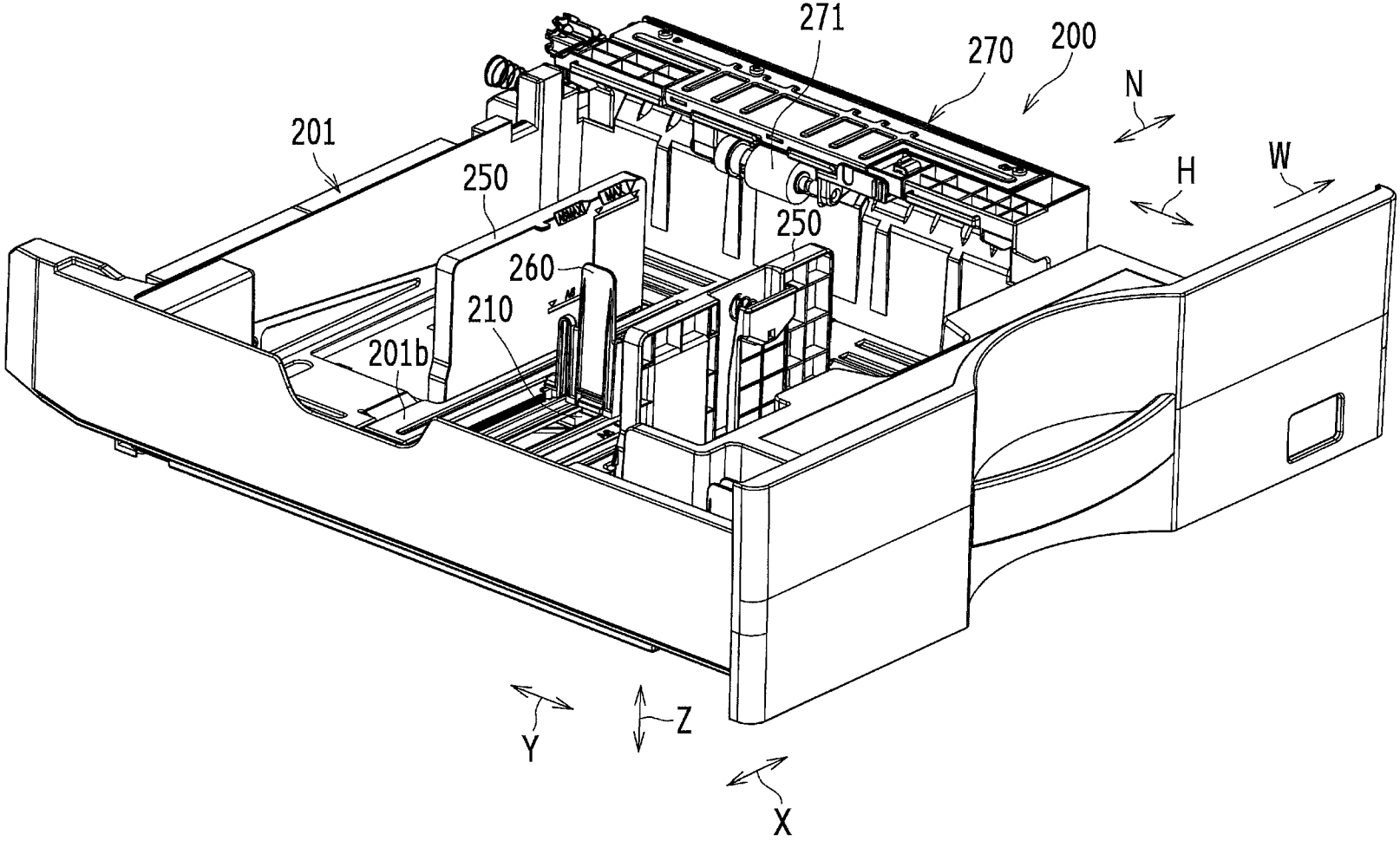
FIG. 2 is a schematic perspective view showing a sheet accommodating device according to the present embodiment as seen from obliquely above the front.
Figure 3:
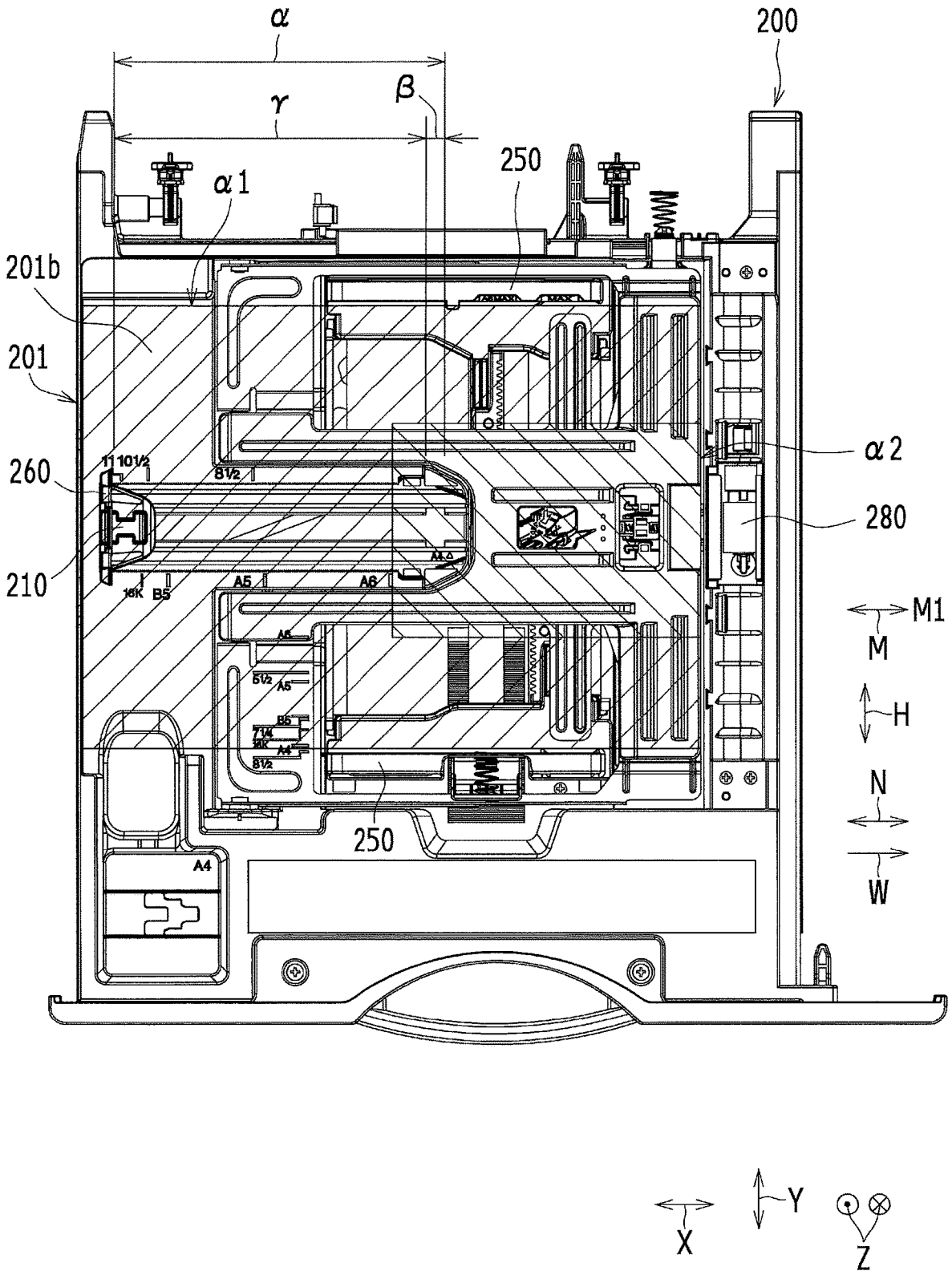
FIG. 3 is a schematic plan view planimetrically showing a state where a moving member to which a rear-end regulating member has been attached is located in a size regulation region in the sheet accommodating device according to the present embodiment with a sheet feeding device removed therefrom.
Figure 4:
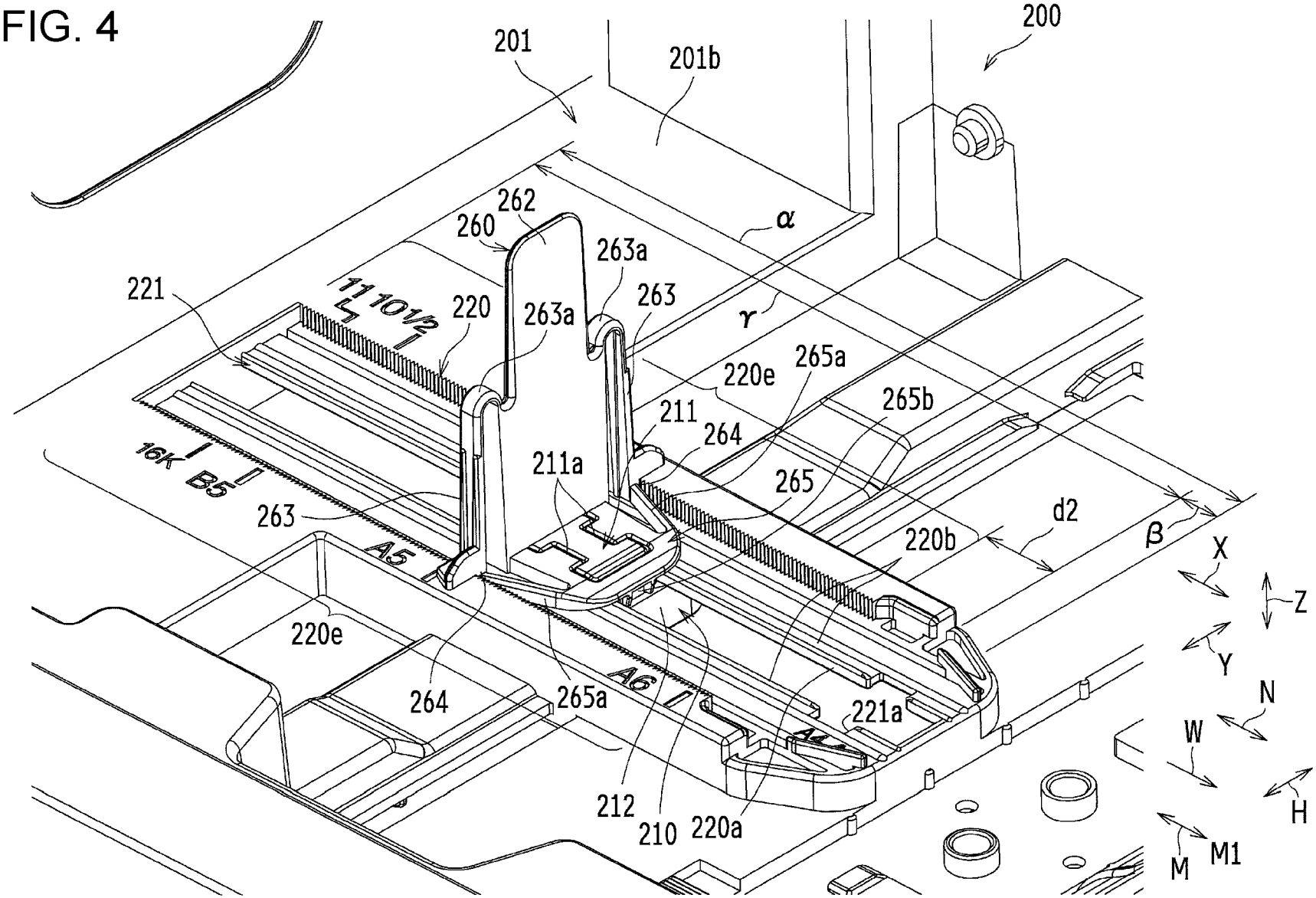
FIG. 4 is a schematic perspective view showing, from obliquely above, a state where the moving member to which the rear-end regulating member has been attached is located in a detachment prohibition region in the sheet accommodating device according to the present embodiment.
Figure 5:
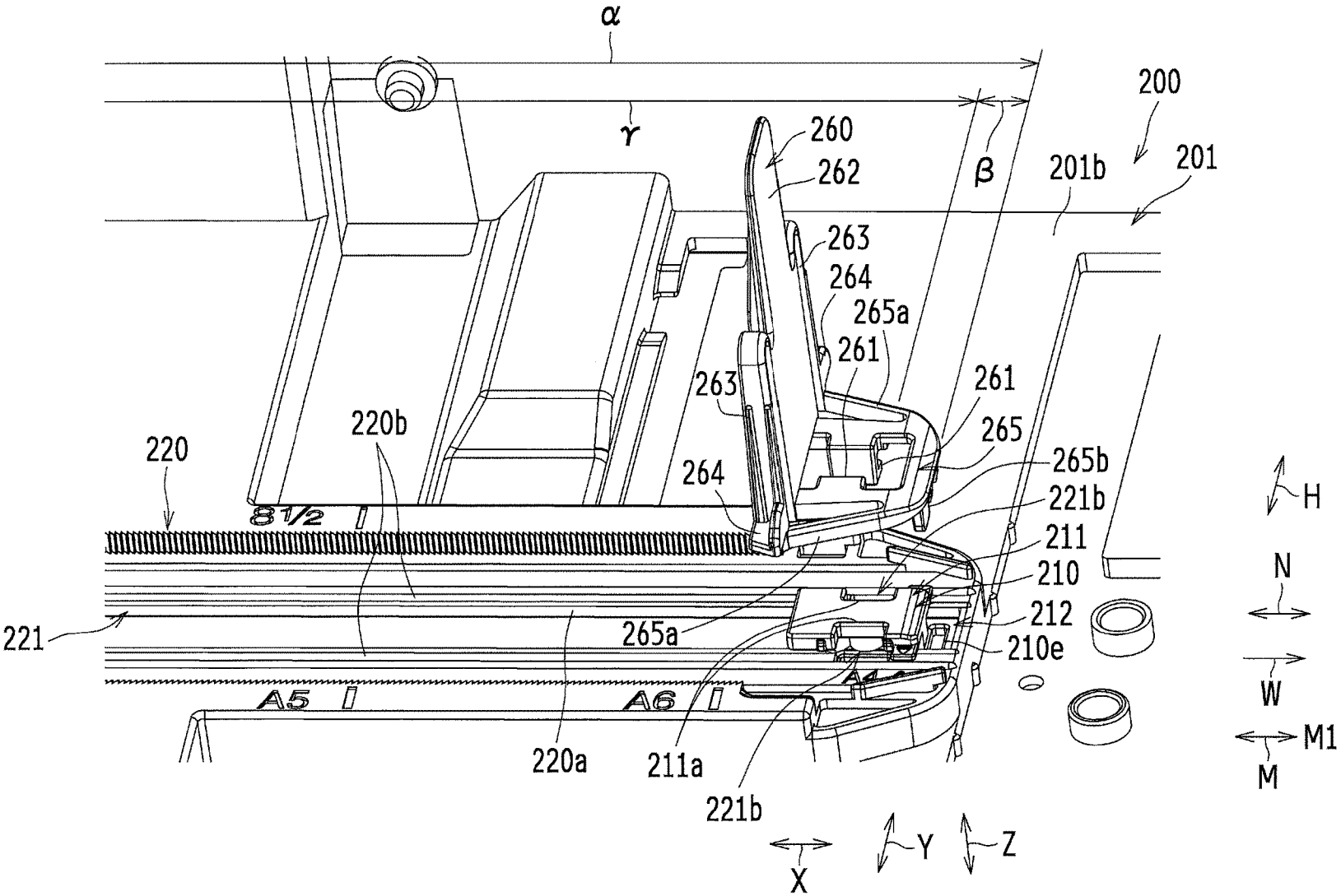
FIG. 5 is a schematic perspective view showing, from obliquely above, a state where the rear-end regulating member has been detached from the moving member in an attaching and detaching position in the sheet accommodating device according to the present embodiment.
Figure 6:
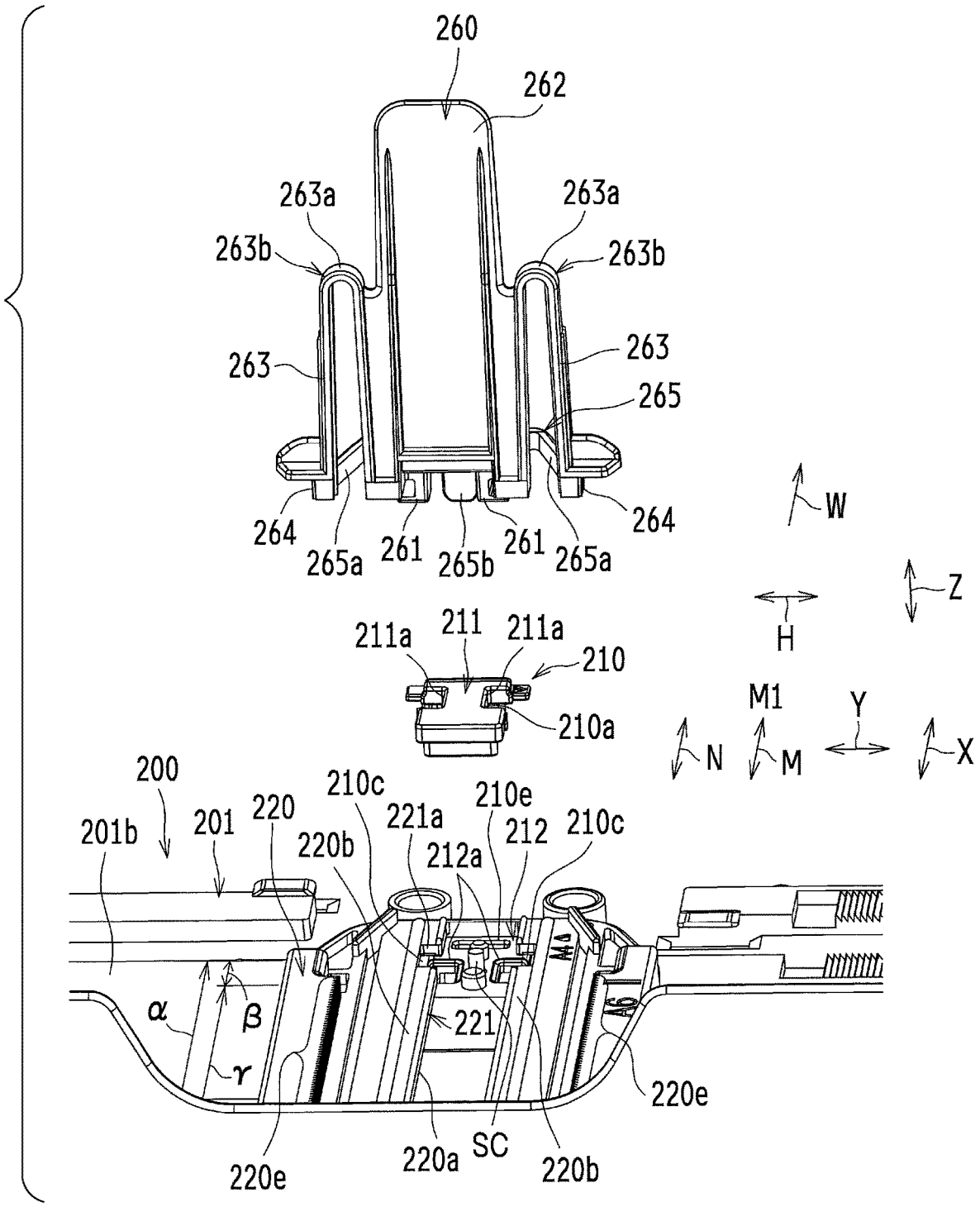
FIG. 6 is a schematic exploded perspective view showing a state where a first moving member has been removed from a second moving member in the moving member from which the rear-end regulating member has been detached in the attaching and detaching position and which is movably attached to a housing in the sheet accommodating device according to the present embodiment.
Figure 7:
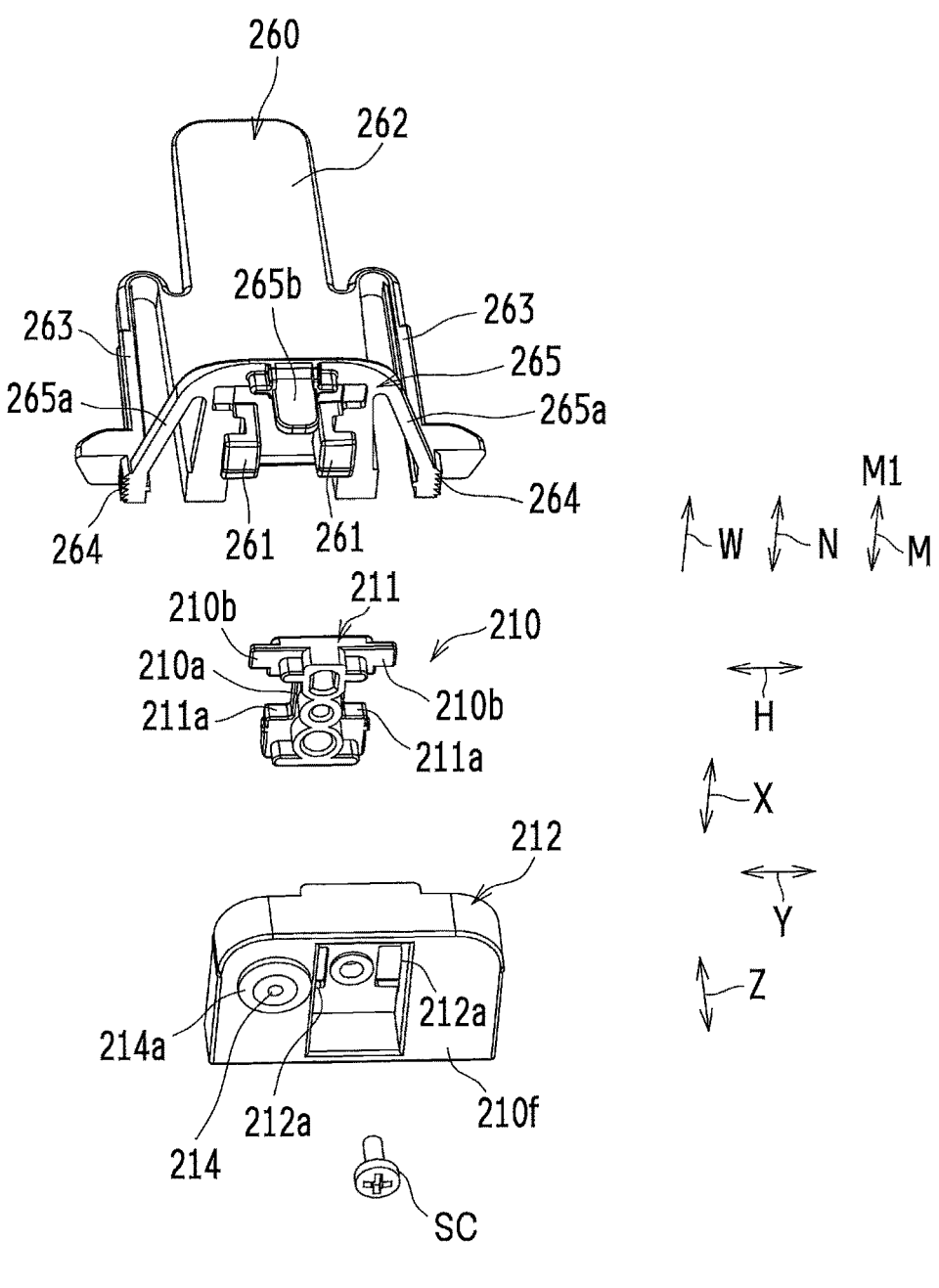
FIG. 7 is a schematic exploded perspective view showing the rear-end regulating member, the first moving member, the second moving member, and a fixing member of the moving member as seen from obliquely below.

FIG. 2 is a schematic perspective view showing a rear-end regulating member 260 of a sheet accommodating device 200 according to the present embodiment as seen from obliquely above the front. FIG. 3 is a schematic plan view planimetrically showing a state where a moving member 210 to which the rear-end regulating member 260 has been attached is located in a size regulation region in the sheet accommodating device 200 according to the present embodiment with a sheet feeding device 270 removed therefrom. FIG. 4 is a schematic perspective view showing, from obliquely above, a state where the moving member 210 to which the rear-end regulating member 260 has been attached is located in a detachment prohibition region γ in the sheet accommodating device 200 according to the present embodiment. FIG. 5 is a schematic perspective view showing, from obliquely above, a state where the rear-end regulating member 260 has been detached from the moving member 210 in an attaching and detaching position β in the sheet accommodating device 200 according to the present embodiment. FIG. 6 is a schematic exploded perspective view showing a state where a first moving member 211 has been removed from a second moving member 212 in the moving member 210 from which the rear-end regulating member 260 has been detached in the attaching and detaching position β and which is movably attached to a housing 201 in the sheet accommodating device 200 according to the present embodiment. FIG. 7 is a schematic exploded perspective view showing the rear-end regulating member 260, the first moving member 211, the second moving member 212, and a fixing member SC of the moving member 210 as seen from obliquely below.

Figure 8:
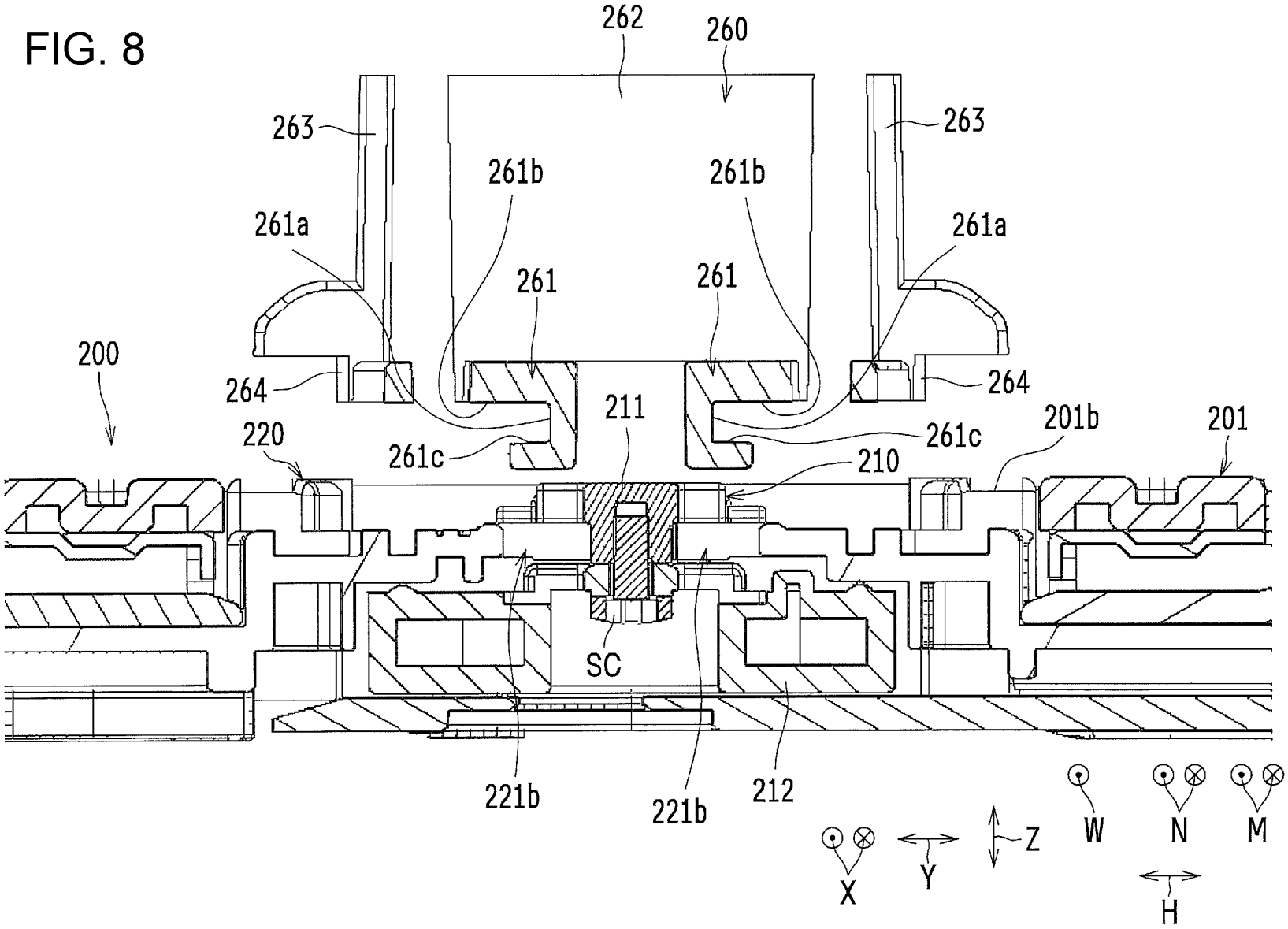
FIG. 8 is a schematic cross-sectional view showing a state where the rear-end regulating member has been detached from the moving member in the attaching and detaching position in the sheet accommodating device according to the present embodiment.
Figure 9:
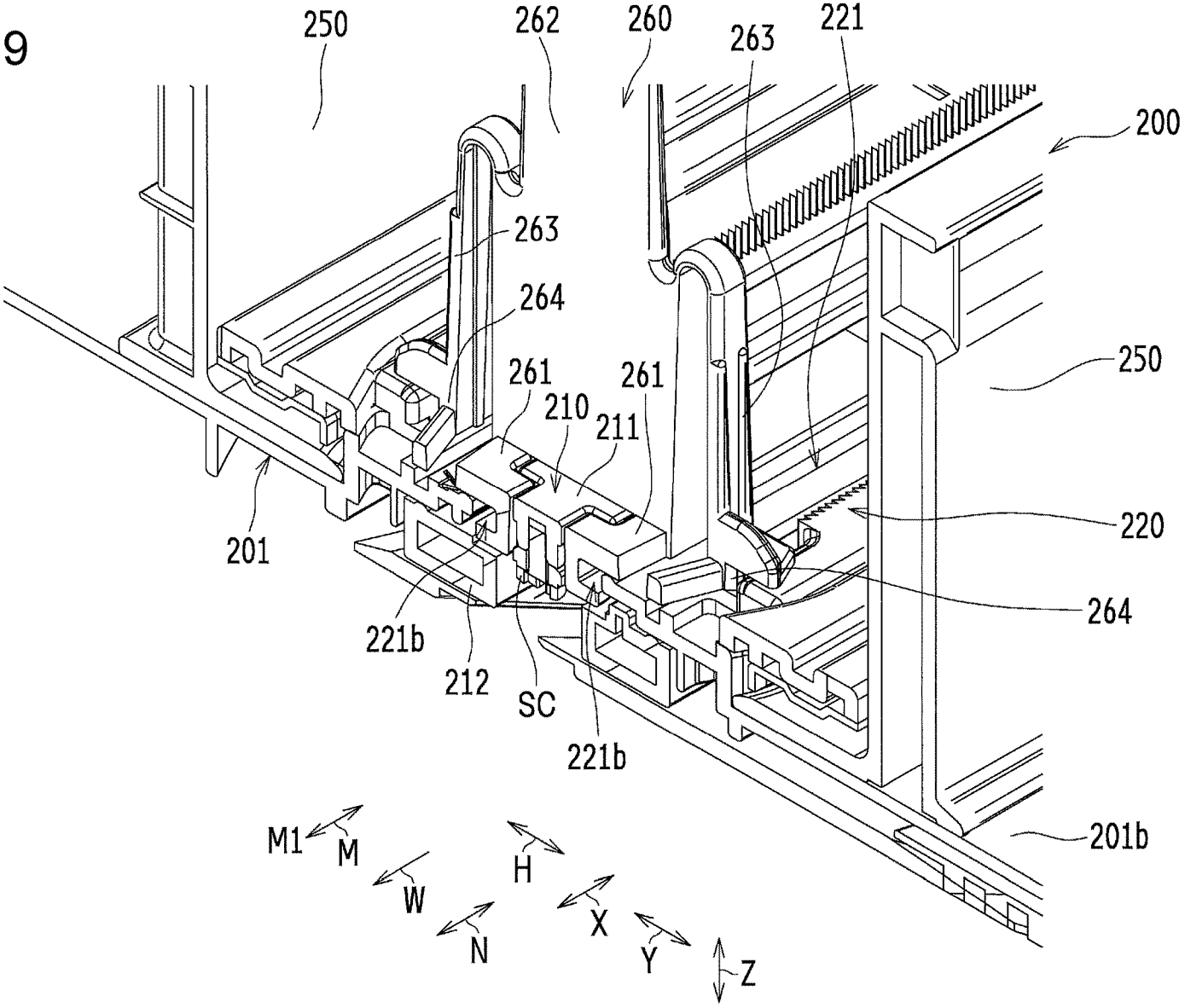
FIG. 9 is a schematic perspective view showing, from obliquely above, a longitudinal section of a part where the rear-end regulating member has been attached to the moving member in the attaching and detaching position in the sheet accommodating device according to the present embodiment.
Figure 10:
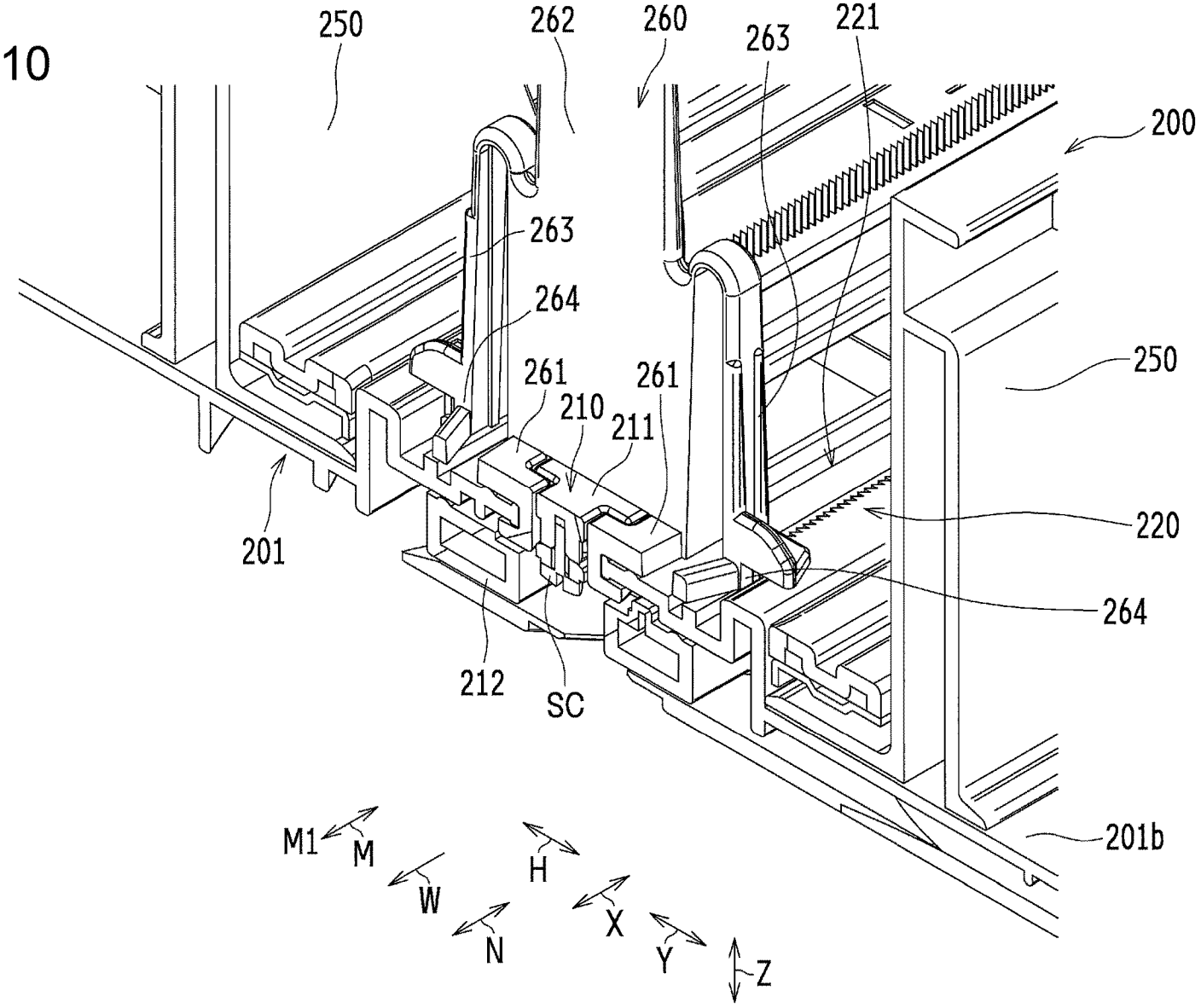
FIG. 10 is a schematic perspective view showing, from obliquely above, a longitudinal section of a part where the rear-end regulating member has been attached to the moving member in the detachment prohibition region in the sheet accommodating device according to the present embodiment.
Figure 11:
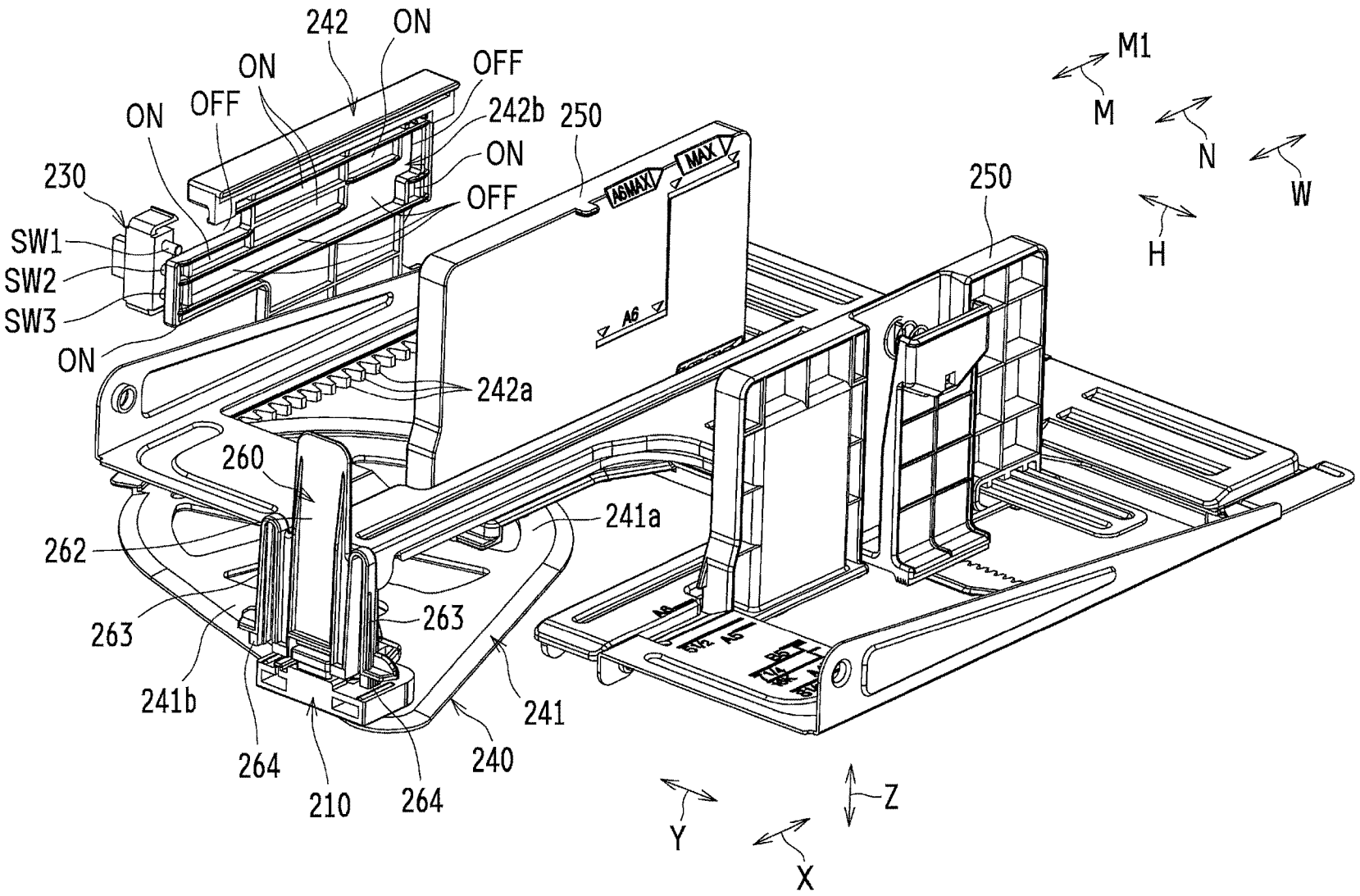
FIG. 11 is a schematic perspective view showing, from obliquely above, a state of detection of a size detecting device by a detection mechanism during the time when sheets are regulated by the rear-end regulating member attached to the moving member.
Figure 12:
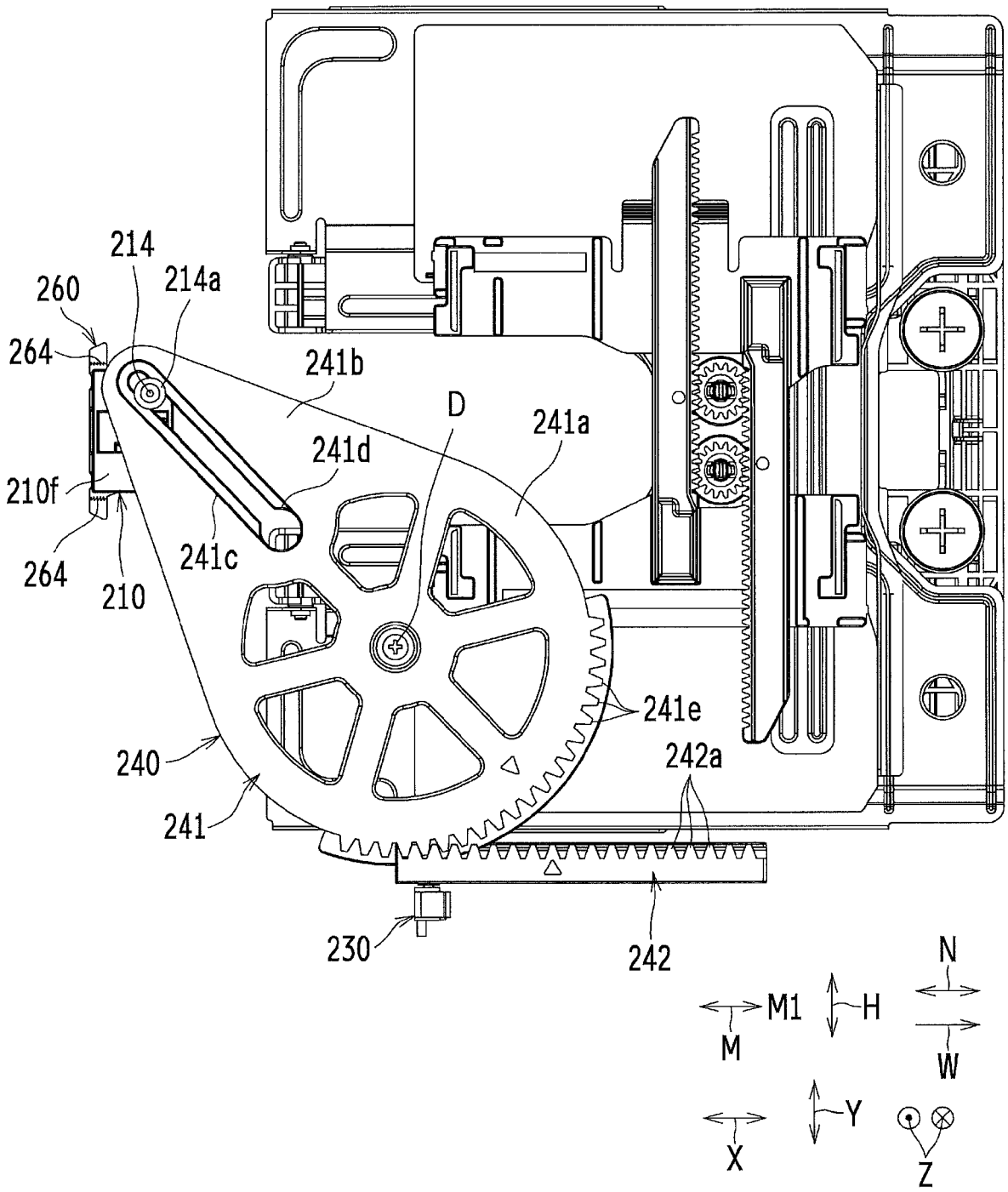
FIG. 12 is a schematic bottom view showing a state shown in FIG. 11 as seen from the bottom.
Figure 13:
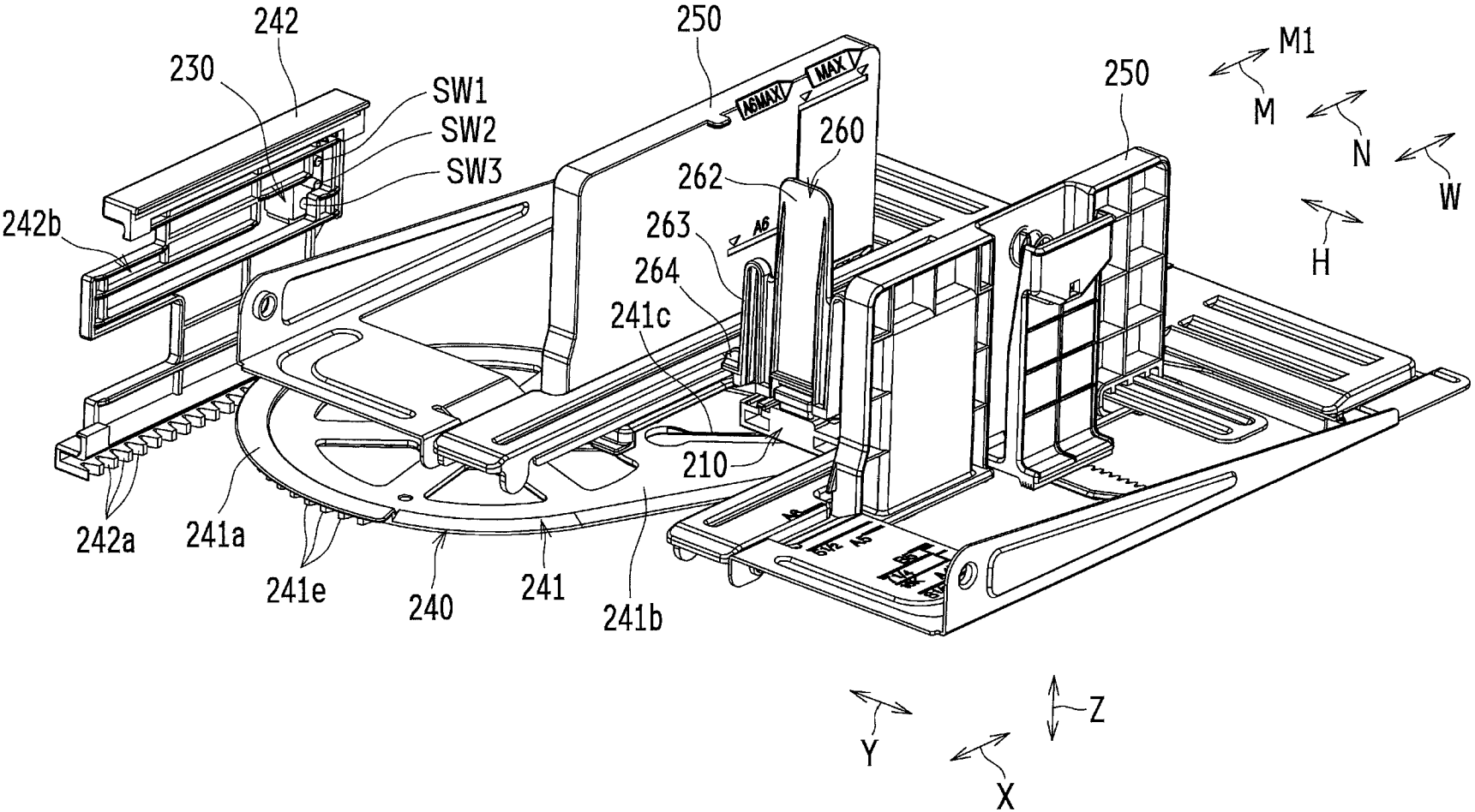
FIG. 13 is a schematic perspective view, from obliquely above, a state of detection of the size detecting device by the detection mechanism during the time when the moving member to which the rear-end regulating member has been attached is located in the attaching and detaching position.
Figure 14:
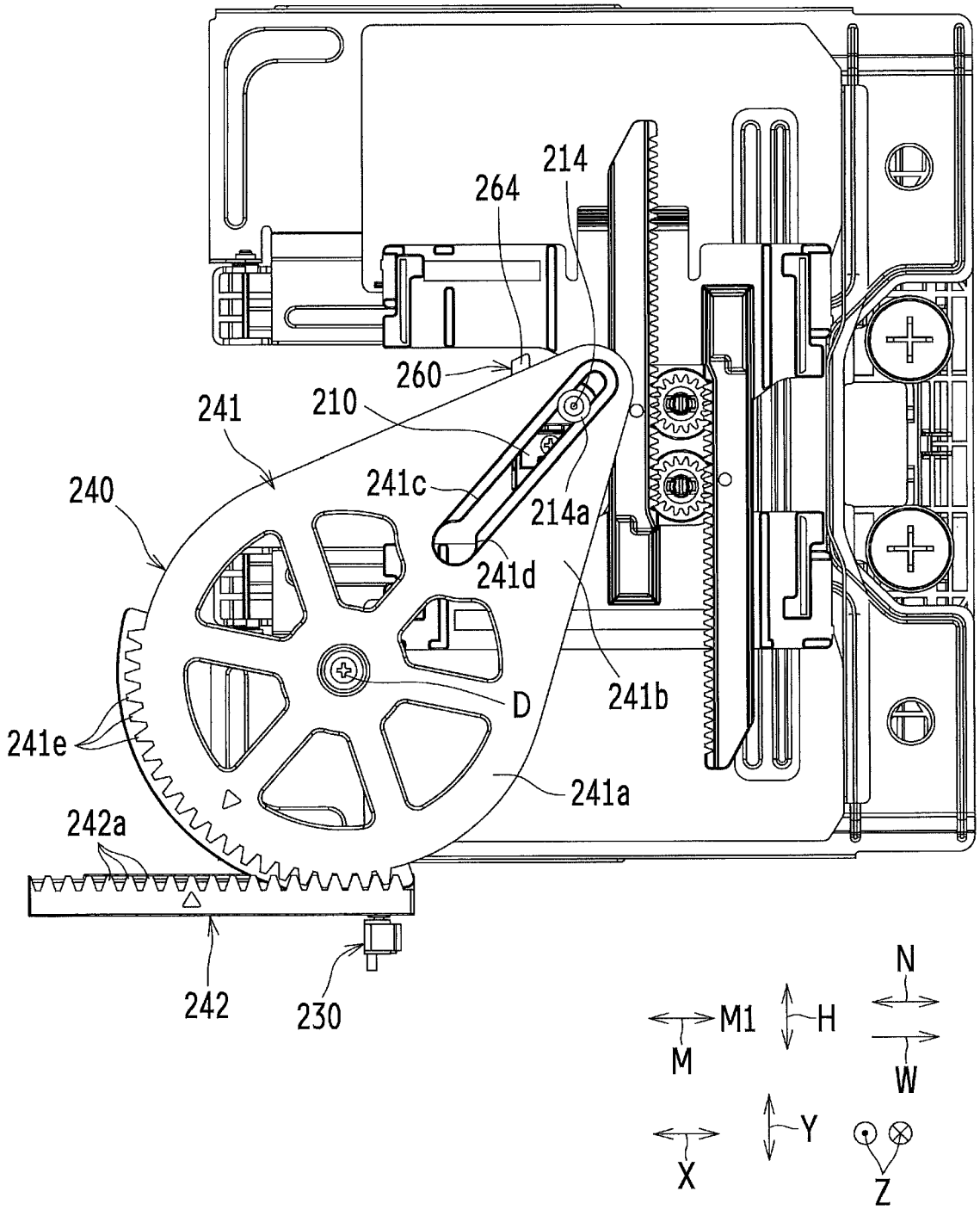
FIG. 14 is a schematic bottom view showing a state shown in FIG. 13 as seen from the bottom.
Figure 15A:
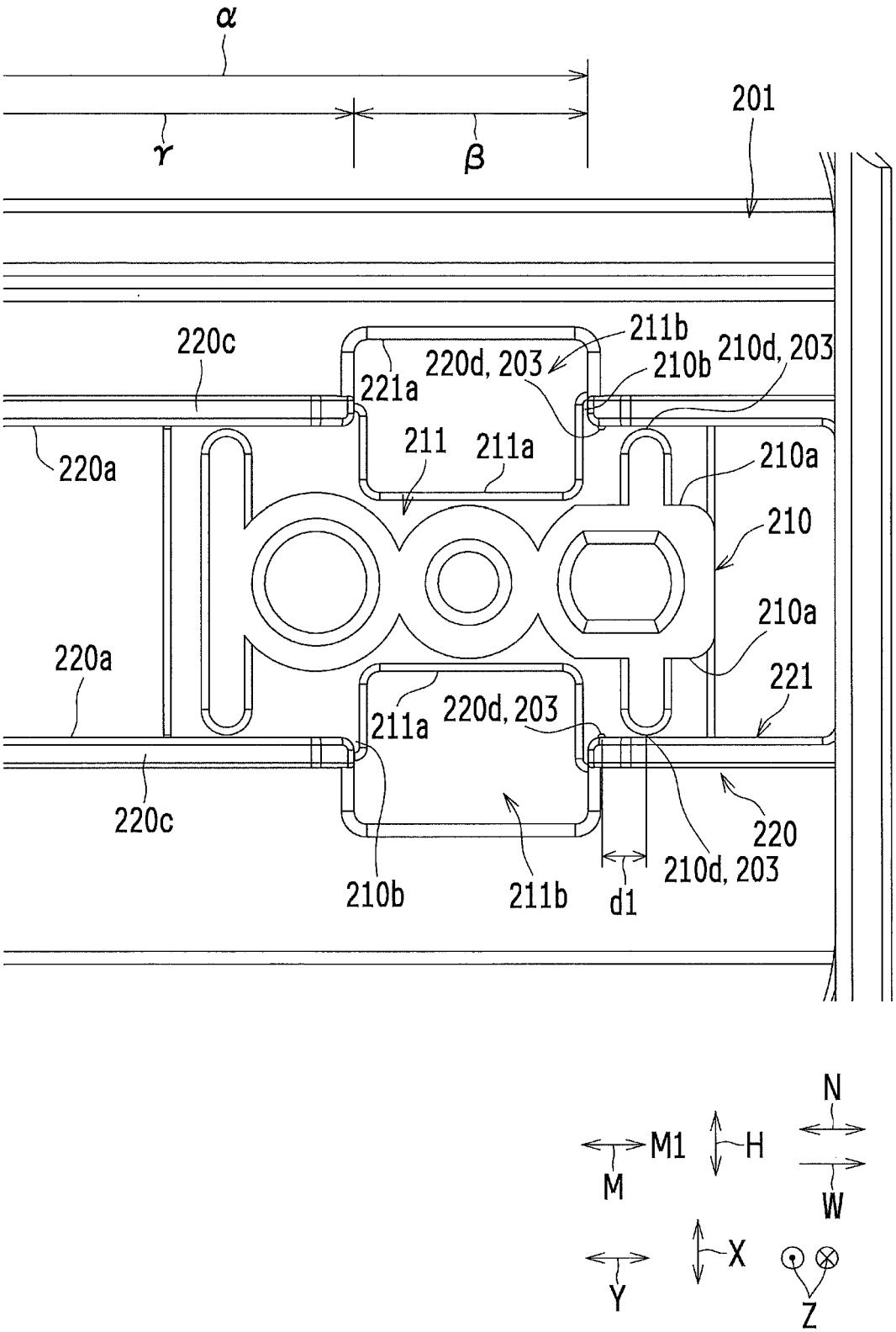
FIG. 15A is an enlarged bottom view showing first and second raised portions that constitute a slide regulator in the moving member with the second moving member removed therefrom.
Figure 15B:
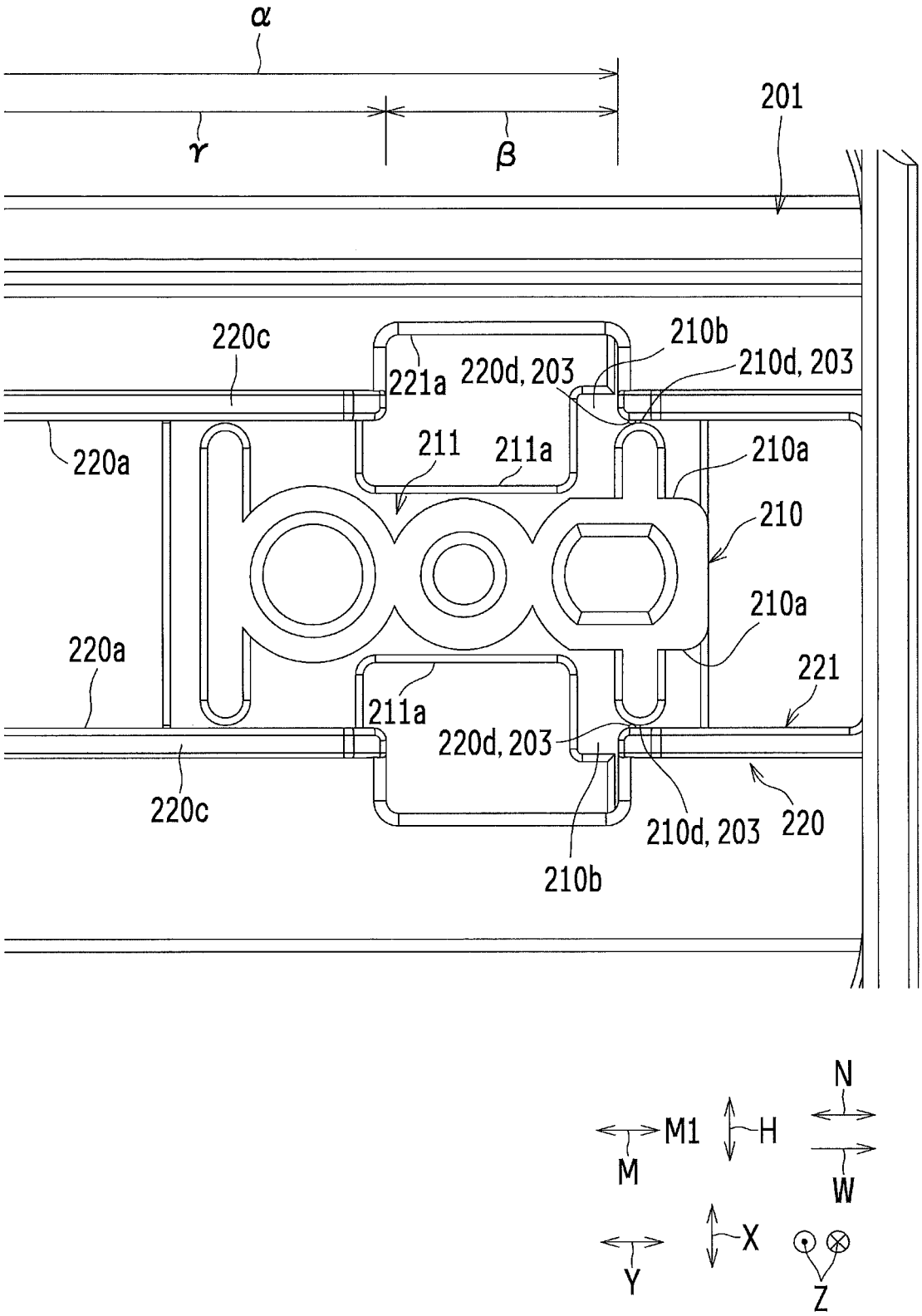
FIG. 15B is an enlarged bottom view showing a state where the second raised portion is about to move or has just moved beyond the first raised portion in the slide regulator shown in FIG. 15A.
Figure 15C:
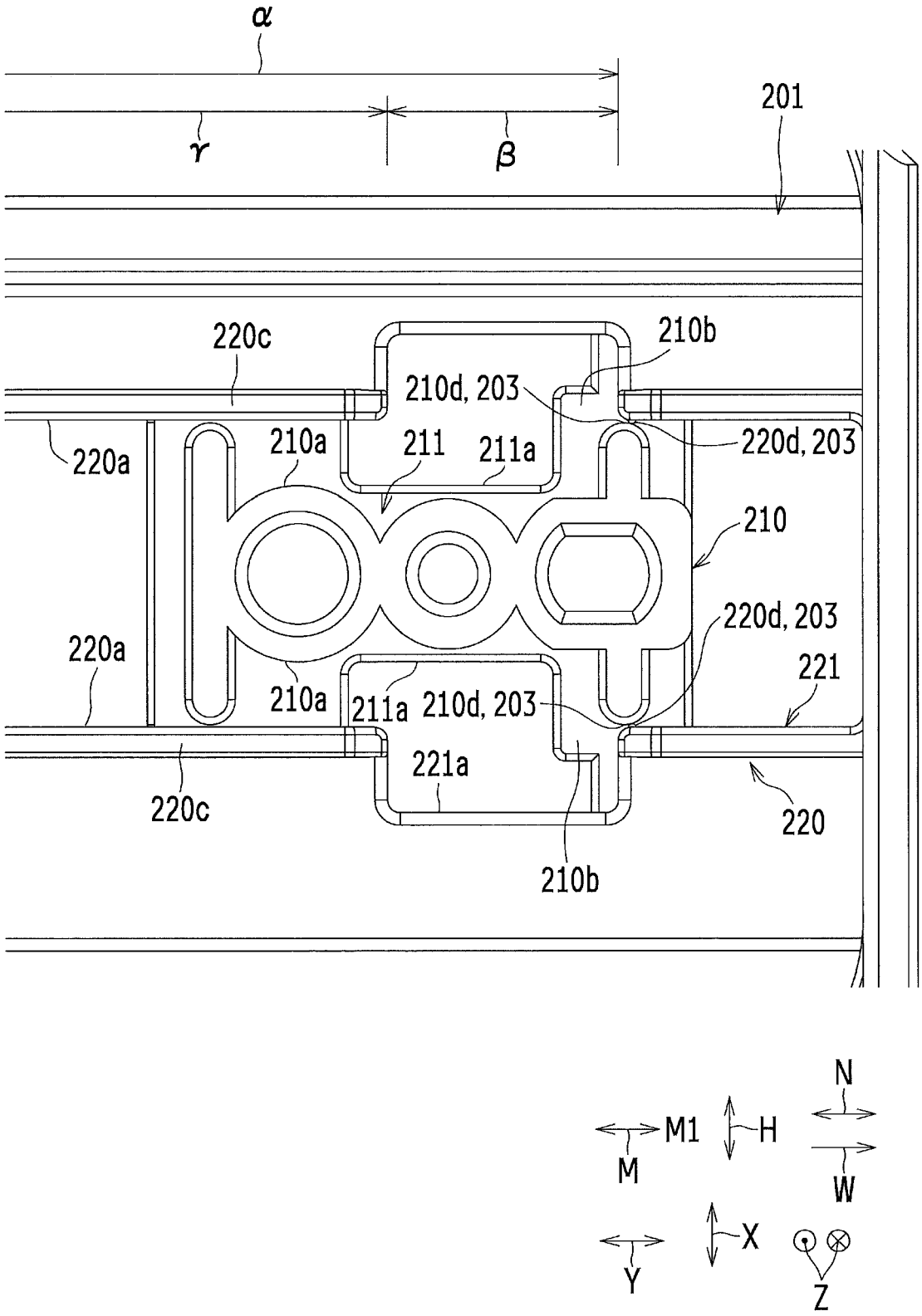
FIG. 15C is an enlarged bottom view showing a state where the second raised portion has just moved or is about to move beyond the first raised portion in the slide regulator shown in FIG. 15A.

FIG. 8 is a schematic cross-sectional view showing a state where the rear-end regulating member 260 has been detached from the moving member 210 in the attaching and detaching position β in the sheet accommodating device 200 according to the present embodiment. FIG. 9 is a schematic perspective view showing, from obliquely above, a longitudinal section of a part where the rear-end regulating member 260 has been attached to the moving member 210 in the attaching and detaching position β in the sheet accommodating device 200 according to the present embodiment. FIG. 10 is a schematic perspective view showing, from obliquely above, a longitudinal section of a part where the rear-end regulating member 260 has been attached to the moving member 210 in the detachment prohibition region γ in the sheet accommodating device 200 according to the present embodiment. FIG. 11 is a schematic perspective view showing, from obliquely above, a state of detection of a size detecting device 230 by a detection mechanism 240 during the time when sheets are regulated by the rear-end regulating member 260 attached to the moving member 210. FIG. 12 is a schematic bottom view showing a state shown in FIG. 11 as seen from the bottom. FIG. 13 is a schematic perspective view, from obliquely above, a state of detection of the size detecting device 230 by the detection mechanism 240 during the time when the moving member 210 to which the rear-end regulating member 260 has been attached is located in the attaching and detaching position β. FIG. 14 is a schematic bottom view showing a state shown in FIG. 13 as seen from the bottom. FIG. 15A is an enlarged bottom view showing first and second raised portions 220*d* and 210*d* that constitute a slide regulator 203 in the moving member 210 with the second moving member 212 removed therefrom. FIG. 15B is an enlarged bottom view showing a state where the second raised portion 210*d* is about to move or has just moved beyond the first raised portion 220*d* in the slide regulator 203 shown in FIG. 15A. Further, FIG. 15C is an enlarged bottom view showing a state where the second raised portion 210*d* has just moved or is about to move beyond the first raised portion 220*d* in the slide regulator 203 shown in FIG. 15A.

First Embodiment

The sheet accommodating device 200 includes a regulating member (or more specifically, width regulating members 250 and/or a rear-end regulating member 260) that regulates end portions of sheets. The width regulating members 250 regulate, in a first direction (width direction H), both end portions of the sheets in the width direction H extending along a sheet surface orthogonal to a sheet feed direction W. The rear-end regulating member 260 regulates, in a second direction (length direction N), rear-end portions of the sheets in the second direction extending along the sheet feed direction W. In this example, the regulating member is the rear-end regulating member 260. Further, the sheet accommodating device 200 includes a moving member 210. The moving member 210 is provided in a body (or more specifically, the housing 201) of the sheet accommodating device 200 so as to be movable in a direction crossing (in this example, orthogonal to) the vertical direction Z (or more specifically, along a bottom surface 201*b* of the housing 201).

Moreover, the rear-end regulating member 260 is detachably provided on the moving member 210, and a moving region α (see, for example, FIGS. 3 to 6) of the moving member 210 includes a size regulation region α1 (see a part indicated by diagonal lines extending from bottom left to top right in FIG. 3) where the end portions of the sheets are regulated and a non-size regulation region α2 (see a part indicated by diagonal lines extending from top left to bottom right in FIG. 3) excluding the size regulation region. Moreover, the sheet accommodating device 200 is configured to permit the rear-end regulating member 260 to be attached to and detached from the moving member 210 in a predetermined attaching and detaching position β (see, for example, FIGS. 3 to 6) of the non-size regulation region α2 and prohibit the rear-end regulating member 260 from being detached from the moving member 210 in a detachment prohibition region γ (see, for example, FIGS. 3 to 6) of the moving region α excluding the attaching and detaching position β.

Since the rear-end regulating member 260 is detachably provided on the moving member 210 movably provided in the housing 201, the first embodiment makes it possible, even with a configuration in which the rear-end regulating member 260 is attached and detached, to handle sheets of any size that is equal to or smaller than a maximum accommodatable size (in this example, A4 portrait size). For example, the sheet accommodating device 200 can easily handle both centimeter specifications and inch specifications. Moreover, the sheet accommodating device 200 is configured to permit the rear-end regulating member 260 to be attached to and detached from the moving member 210 in the predetermined attaching and detaching position β of the non-size regulation region α2 and prohibit the rear-end regulating member 260 from being detached from the moving member 210 in the detachment prohibition region γ of the moving region α excluding the attaching and detaching position β. Accordingly, when the rear-end regulating member 260 is located in the detachment prohibition region γ (especially when the rear-end regulating member 260 is regulating the rear-end portions of the sheets), detachment of the rear-end regulating member 260 from the moving member 210 is prohibited. Meanwhile, when an operator such as a user would like to detach the rear-end regulating member 260 from the moving member 210, it is necessary to put the rear-end regulating member 260 in the attaching and detaching position β of the non-size regulation region α2. This allows the operator to avoid detaching the rear-end regulating member 260 even when he/she does not intend to detach the rear-end regulating member 260.

More specifically, the housing 201 is provided with a guide 220 (see, for example, FIGS. 4 to 6 and 8 to 10) that movably guides the moving member 210. The guide 220 has a long through hole 221 (slit) (see, for example, FIGS. 4 to 6, 9, and 10) extending along the length direction N. The long through hole 221 has an enlarged hole 221*a* (see, for example, FIGS. 4 and 6) whose size in the width direction H in the attaching and detaching position β is larger than a size thereof in the width direction H in the detachment prohibition region γ. The moving member 210 includes a first moving member 211 (see, for example, FIGS. 4 to 10) and a second moving member 212 (see, for example, FIGS. 4 to 10). The first moving member 211 is attached to the second moving member 212 by a fixing member SC (see, for example, FIGS. 6 to 10) such as a screw. The first moving member 211 has depressed portions 211*a* (see, for example, FIGS. 4 to 7) provided on both sides thereof in the width direction H and depressed inward. The depressed portions 211*a* constitute first attaching and detaching holes 211*b* (see FIG. 15A) together with the enlarged hole 221*a* of the guide 220 when the moving member 210 is located in the attaching and detaching position β. The second moving member 212 has second attaching and detaching holes 212*a* (see FIGS. 6 and 7), provided in positions corresponding to the depressed portions 211*a* of the first moving member 211, that are identical or substantially identical in shape to the first attaching and detaching holes 211*b*. The moving member 210 has a first holding surface 210*a* (see, for example, FIGS. 6 and 7), a second holding surface 210*b* (see, for example, FIG. 7), and a third holding surface 210*c* (see FIG. 6) that hold a side surface 220*a* (see, for example, FIGS. 4 to 6) of the guide 220 that faces the moving member 210, an upper surface 220*b* (see FIGS. 4 to 6) of the guide 220, and a lower surface 220*c* (see FIGS. 15A to 15C) of the guide 220, respectively. This allows the moving member 210 to reciprocate along the length direction N with respect to the guide 220. In this example, the first moving member 211 has the first holding surface 210*a* and the second holding surface 210*b*, and the second moving member 212 has the third holding surface 210*c*.

The rear-end regulating member 260 is provided with sliders 261 (see FIGS. 5 to 10) that slide along the guide 220. The sliders 261 are configured to be inserted through attaching and detaching holes 221*b* (see FIGS. 5, 8, and 9), which are formed when the moving member 210 is located in the attaching and detaching position β, so as to be movable along the vertical direction Z. Further, the sliders 261 are configured to be movable along the length direction N while being kept from moving along the vertical direction Z or the width direction H in the detachment prohibition region γ of the long through hole 221 of the guide 220. Specifically, a whole size of the sliders 261 in the width direction H is smaller than the size of the long through hole 221 in the width direction H in the attaching and detaching position β and larger than the size of the long through hole 221 in the width direction H in the detachment prohibition region γ. Each of the sliders 261 has a first holding surface 261*a* (see FIG. 8), a second holding surface 261*b* (see FIG. 8), and a third holding surface 261*c* (see FIG. 8) that hold the side surface 220*a*, the upper surface 220*b*, and the lower surface 220*c* of the guide 220, respectively. This allows the guide 220 to permit the rear-end regulating member 260 to be attached to and detached from the moving member 210 in the predetermined attaching and detaching position β and prohibit the rear-end regulating member 260 from being detached from the moving member 210 in the detachment prohibition region γ.

Incidentally, the non-size regulation region α2 includes a region outside a region where sheets of the maximum accommodatable size (in this example, A4 portrait size) are mounted; however, putting the attaching and detaching position β in this region invites upsizing of the sheet accommodating device 200. Accordingly, it is desirable to put the attaching and detaching position β in such a position as to achieve downsizing of the sheet accommodating device 200.

In this regard, the first embodiment is configured such that a region where sheets of a minimum accommodatable size are mounted is the non-size regulation region α2. The attaching and detaching position β is located within the region where the sheets of the minimum accommodatable size (in this example, A6 portrait size) are mounted. This makes it possible to attach and detach the rear-end regulating member 260 to and from the moving member 210 located in the attaching and detaching position β within the region where the sheets of the minimum accommodatable size are mounted. This makes it possible to achieve downsizing of the sheet accommodating device 200.

The first embodiment is configured such that the sheet accommodating device 200 includes a detection mechanism 240 (see FIGS. 11 to 14) that causes a size detecting device 230 (see FIGS. 11 to 14) to detect a size of the sheets. The moving member 210 interlocks with the detection mechanism 240. This allows the size detecting device 230 to surely detect the size of the sheets according to a position to which the moving member 210 has moved. It should be noted that FIGS. 11 to 14 omit to illustrate the housing 201 or the like.

More specifically, the size detecting device 230 is provided in the image forming apparatus body 110. The detection mechanism 240 includes a turning member 241 and a detected member 242. The turning member 241 is provided in the housing 201 so at to be turnable around a turning axis (in this example, a turning axis D [see FIGS. 12 and 14] of a shoulder screw) extending along the vertical direction Z. The detected member 242 is provided in the housing 201 so as to be reciprocable along the length direction N or the width direction H (in this example, the length direction N). The turning member 241 has a disk-shaped body part 241*a* and an extension part 241*b* provided as a part of the circumference of the body part 241*a*. The extension part 241*b* extends in a radial direction centered at the turning axis D. The extension part 241*b* has a long through hole 241*c* (slit) (see FIGS. 12 to 14) extending in a radial direction centered at the turning axis D. The moving member 210 (in this example, the second moving member 212) is provided with a projecting shaft 214 (see FIGS. 7, 12, and 14) that projects downward and is inserted through the long through hole 241*c* so as to be movable along the long through hole 241*c*. The projecting shaft 214 is provided on a lower surface 210*f* (see FIGS. 7 and 12) of the moving member 210 (in this example, the second moving member 212). The projecting shaft 214 is provided with a pullout preventer 214*a* (see FIGS. 7, 12, and 14) that prevents pullout of the projecting shaft 214 from the long through hole 241*c*. This makes it possible to effectively prevent pullout of the projecting shaft 214 from the long through hole 241*c*. Further, the turning member 241 has an insertion hole 241*d* (see FIGS. 12 and 14), provided in an inner end portion of the long through hole 241*c*, through which the pullout preventer 214*a* is inserted. This makes it possible to easily detach the pullout preventer 214*a* from the long through hole 241*c*. The body part 241*a* has a pinion gear 241*e* (see FIGS. 12 to 14) provided on a side thereof opposite to the extension part 241*b*. In this example, the pinion gear 241*e* is formed so as to be linearly symmetrical with respect to an imaginary straight line passing through the centers of the projecting shaft 214 and the turning axis D. A surface of the detected member 242 that faces the pinion gear 241*e* is provided with a rack gear 242*a* that intermeshes with the pinion gear 241*e*. In the sheet accommodating device 200 thus configured, the moving member 210 reciprocates along a direction of movement M, whereby the projecting shaft 214 reciprocates along the long through hole 241*c* and the turning member 241 turns around the turning axis D. This allows the detected member 242 to reciprocate along the direction of movement M.

Further, a surface of the detection member 242 opposite to the pinion gear 241*e* is provided with an actuator 242*b* (see FIGS. 11 and 13) for actuating the size detecting device 230. In this example, the size detecting device 230 has a plurality of (in this example, three) detectors SW1, SW2, and SW3 (see FIGS. 11 and 13). The detectors SW1, SW2, and SW3 are push switches that turn on when subjected to external force and turn off when released from external force. The actuator 242*b* has an enabler ON (see FIG. 11) that turns on at least one of the detectors SW1, SW2, and SW3 according to a position in the direction of movement M of the detected member 242 that reciprocates and a disabler OFF (see FIG. 11) that turns off at least one of the detectors SW1, SW2, and SW3 according to the position in the direction of movement M of the detected member 242 that reciprocates. Specifically, the enabler ON is a plane portion, and the disabler OFF is a depressed portion or a through hole (in this example, a through hole).

The following table tabulates examples of states of detection of the detectors SW1, SW2, and SW3 according to the position in the direction of movement M of the detected member 242 that reciprocates.

Table of States of Detection of Detectors

| Position of Moving Member 210 | SW1 | SW2 | SW3 |
|---|---|---|---|
| Regulating Position of 11 Size (See FIG. 11) | OFF | ON | ON |
| Regulating Position of B5, 10½, and 16K Sizes | OFF | ON | OFF |
| Regulating Position of A5 and 8½ Sizes | ON | ON | OFF |

-continued

| Table of States of Detection of Detectors | | | |
|---|---|---|---|
| Position of Moving Member 210 | SW1 | SW2 | SW3 |
| Regulating Position of A6 Size | ON | OFF | OFF |
| Attaching and detaching position β (See FIG. 13) | OFF | OFF | ON |

The image forming apparatus 100 is electrically connected to an input system of a controller 130 (see FIG. 1) by the size detecting device 230. The controller 130 can recognize, from the states of detection of the detectors SW1, SW2, and SW3 of the size detecting device 230 depending on the position of the moving member 210, the size of the sheets accommodated in the sheet accommodating device 200. This allows the controller 130 to perform image processing according to the size of the sheets accommodated in the sheet accommodating device 200.

Incidentally, unintentional movement of the moving member 210 away from the attaching and detaching position β during attachment or detachment of the moving member 210 in the attaching and detaching position β makes it necessary to perform an operation of putting the moving member 210 back in the attaching and detaching position β. It takes a lot of trouble to perform the operation of putting the moving member 210 in the attaching and detaching position β. Accordingly, it is desirable to effectively prevent unintentional movement of the moving member 210 away from the attaching and detaching position β.

In this regard, the first embodiment is configured such that the sheet accommodating device 200 includes a slide regulator 203 (see FIGS. 15A to 15C) that regulates how the moving member 210 slides when the moving member 210 moves from the attaching and detaching position β to the detachment prohibition region γ (i.e. that imparts a sense of resistance to the operator). With this configuration, the moving member 210 cannot be moved unless a predetermined or greater external force (force exerted by the operator) is applied to the moving member 210. Accordingly, unintentional movement of the moving member 210 away from the attaching and detaching position β during attachment or detachment of the moving member 210 in the attaching and detaching position β can be effectively prevented. This makes it possible to save the trouble of performing the operation of putting the moving member 210 in the attaching and detaching position β.

Incidentally, the rear-end regulating member 260 is configured such that when how the moving member 210 slides is regulated by the slide regulator 203 a short way from the attaching and detaching position β, how the moving member 210 slides is regulated in a state where there is no room for moving the moving member 210 to the detachment prohibition region γ with the rear-end regulating member 260 attached thereto. This causes inconvenience such as disengagement of the rear-end regulating member 260 from the moving member 210. Accordingly, it is desirable to prevent inconvenience such as disengagement of the rear-end regulating member 260 from the moving member 210 in moving the moving member 210 to the detachment prohibition region γ with the rear-end regulating member 260 attached thereto.

In this regard, the first embodiment is configured such that the slide regulator 203 is away from the attaching and detaching position β toward the detachment prohibition region γ (in this example, the moving member 210 is located in the detachment prohibition region γ) by a predetermined first moved distance d1 (see FIG. 15A). With this configuration, how the moving member 210 slides can be regulated by the slide regulator 203 after the moving member 210 has moved from the attaching and detaching position β toward the detachment prohibition region γ by the first moved distance d1. Accordingly, how the moving member 210 slides can be regulated by the slide regulator 203 in a state where there is no room for moving the moving member 210 to the detachment prohibition region γ with the rear-end regulating member 260 attached thereto (in this example, a state where attachment and detachment of the rear-end regulating member 260 to and from the moving member 210 are prohibited). This makes it possible to effectively prevent inconvenience such as disengagement of the rear-end regulating member 260 from the moving member 210 in moving the moving member 210 to the detachment prohibition region γ with the rear-end regulating member 260 attached thereto.

The first embodiment is configured such that the guide 220 has a first raised portion 220*d* (see FIGS. 15A to 15C) provided on the side surface 220*a*. The moving member 210 (in this example, the first moving member 211) has a second raised portion 210*d* (see FIGS. 15A to 15C) provided on the first holding surface 210*a* that faces the side surface 220*a* of the guide 220. The first raised portion 220*d* of the guide 220 comes into contact with the second raised portion 210*d* to hinder movement of the moving member 210 along the direction of movement M. The first raised portion 220*d* and the second raised portion 210*d* constitute the slide regulator 203. In this way, movement of the second raised portion 210*d* beyond the raised portion 220*d* allows the moving member 210 to reciprocate along the direction of movement M while how the moving member 210 slides is being regulated. This makes it possible to achieve the slide regulator 203 with a simple configuration.

The first embodiment is configured such that the rear-end regulating member 260 has a catching part 264 (see FIGS. 4 to 14) as a part of the regulating member 260 that faces the guide 220. The guide 220 is provided with a locking region 220*e* (see FIGS. 4 and 6) where the catching part 264 of the rear-end regulating member 260 attached to the moving member 210 is locked. This makes it possible to regulate the movement of the moving member 210, thereby allowing the rear-end regulating member 260 to stably regulate the rear-end portions of the sheets.

More specifically, the locking region 220*e* includes locking regions 220*e* provided on both inner sides, respectively, of the guide 220 in the width direction H. The catching part 264 includes catching parts 264 provided on both outer sides, respectively, of the rear-end regulating member 260 in the width direction H. The catching parts 264 disengagably engage with the locking regions 220*e*. The rear-end regulating member 260 includes a body part 262 (see FIGS. 4 to 11 and 13) and a pair of swinging parts 263 (see FIGS. 4 to 11 and 13) provided at both end portions, respectively, of the body part 262 in the width direction H. The pair of swinging parts 263 are swingable along the width direction H with their upper ends 263*a* (see FIGS. 4 and 6) serving as fulcrums and have their lower ends provided with the catching parts 264. The swinging parts 263 are configured to apply biasing forces outward along the width direction H. When external forces (forces exerted by the operator) are applied to inner sides of the swinging parts 263 in the width direction H, the swinging parts 263 swing inward along the width direction H in resistance to the biasing forces applied outward along the width direction H. Meanwhile, when the external forces (forces exerted by the operator) stop being applied to the inner sides of the swinging parts 263 in the width direction H, the swinging parts 263 return outward along the width direction H due to the biasing forces applied outward along the width direction H. Specifically, the swinging parts 263 have substantially U-shaped bends 263*b* (see FIG. 6) extending upward from both ends along the width direction H in a central part of the body part 262 along the vertical direction Z and bending downward toward both outer sides along the width direction H. The swinging parts 263 are constituted by elastic members and structured such that the bends 263*b* apply biasing forces outward along the width direction H. The catching parts 264 are in the shape of projections and depressions obtained by continuously forming peaks and troughs along the direction of movement M. As with the catching parts 264, the locking regions 220*e* of the guide 220 are in the shape of projections and depressions obtained by continuously forming peaks and troughs along the direction of movement M. This makes it possible to regulate the movement of the moving member 210 by using the locking regions 220*e* to lock the catching parts 264 of the rear-end regulating member 260 attached to the moving member 210.

Incidentally, when locked in the locking regions 220*e* a short way from the attaching and detaching position β, the moving member 210 makes it necessary for the operator to simultaneously perform a moving operation of moving the moving member 210 to the detachment prohibition region γ with the rear-end regulating member 260 attached thereto and a locking operation of regulating the movement of the moving member 210 by locking the catching parts 264 in the locking regions 220*e*. This cause deterioration in operability with which to attach the rear-end regulating member 260. Accordingly, it is desirable to improve the operability with which to attach the rear-end regulating member 260.

In this regard, the first embodiment is configured such that the locking regions 220*e* are away from the attaching and detaching position β toward the detachment prohibition region γ (in this example, the moving member 210 is located in the detachment prohibition region γ) by a predetermined second moved distance d2 (see FIG. 4). This allows the rear-end regulating member 260 to regulate the movement of the moving member 210 in the locking regions 220*e* after the moving member 210 has moved from the attaching and detaching position β toward the detachment prohibition region γ by the second moved distance d2 (in this example, in a state where attachment and detachment of the rear-end regulating member 260 to and from the moving member 210 are prohibited). This allows the operator to, after the moving operation of moving the moving member 210 to the detachment prohibition region γ with the rear-end regulating member 260 attached thereto (in this example, in a state where the moving member 210 is prohibited from being detached in the detachment prohibition region γ), perform the locking operation of regulating (or specifically, releasably regulating) the movement of the moving member 210 by locking the catching parts 264 in the locking regions 220*e*. This makes it possible to improve the operability with which to attach the rear-end regulating member 260.

It is preferable that the first moved distance d1 be shorter than the second moved distance d2 or equal to the second moved distance d2. This allows the moving member 210 to reach the locking regions 220*e* after or at a point of time where how the moving member 210 slides has been regulated by the slide regulator 203 with the moving member 210 moved from the attaching and detaching position β toward detachment prohibition region γ.

The first embodiment is configured such that the rear-end regulating member 260 and the moving member 210 are provided with a slant prevention mechanism that prevents the rear-end regulating member 260 from slanting. This makes it possible to effectively prevent the rear-end regulating member 260 from slanting when the rear-end regulating member 260 is attached to the moving member 210. In particular, the slant prevention mechanism prevents the rear-end regulating member 260 from slanting along the direction of movement M of the moving member 210. This makes it possible to inhibit the rear-end regulating member 260 from slanting (especially along the direction of movement M of the moving member 210) when the moving member 210 is moved along the direction of movement M with the rear-end regulating member 260 attached to the moving member 210.

More specifically, the rear-end regulating member 260 further includes a coupling part 265 (see FIGS. 4 to 7) that couples the pair of swinging parts 263. The coupling part 265 couples lower end portions of the swinging parts 263. The coupling part 265 has substantially V-shaped supports 265*a* (see FIGS. 4 to 7) extending inward from both ends of a lower end portion of the body part 262 in the width direction H to one side M1 of the direction of movement M and coupled in a central part of the body part 262 in the width direction H. The sliders 261 are provided on a lower surface of the coupling part 265. Further, the coupling part 265 has a protruding portion 265*b* (see FIGS. 4 to 7), provided at a front-end portion thereof, which protrudes downward. The moving member 210 (in this example, the second moving member 212) is provided with an insertion hole 210*e* (see FIGS. 5 and 6) through which the protruding portion 265*b* is inserted. This allows the coupling part 265 to support the body part 262 on the moving member 210 by means of the protruding portion 265*b*. This makes it possible to effectively prevent the rear-end regulating member 260 from slanting when the rear-end regulating member 260 is attached to the moving member 210.

Second Embodiment

Figure 16:
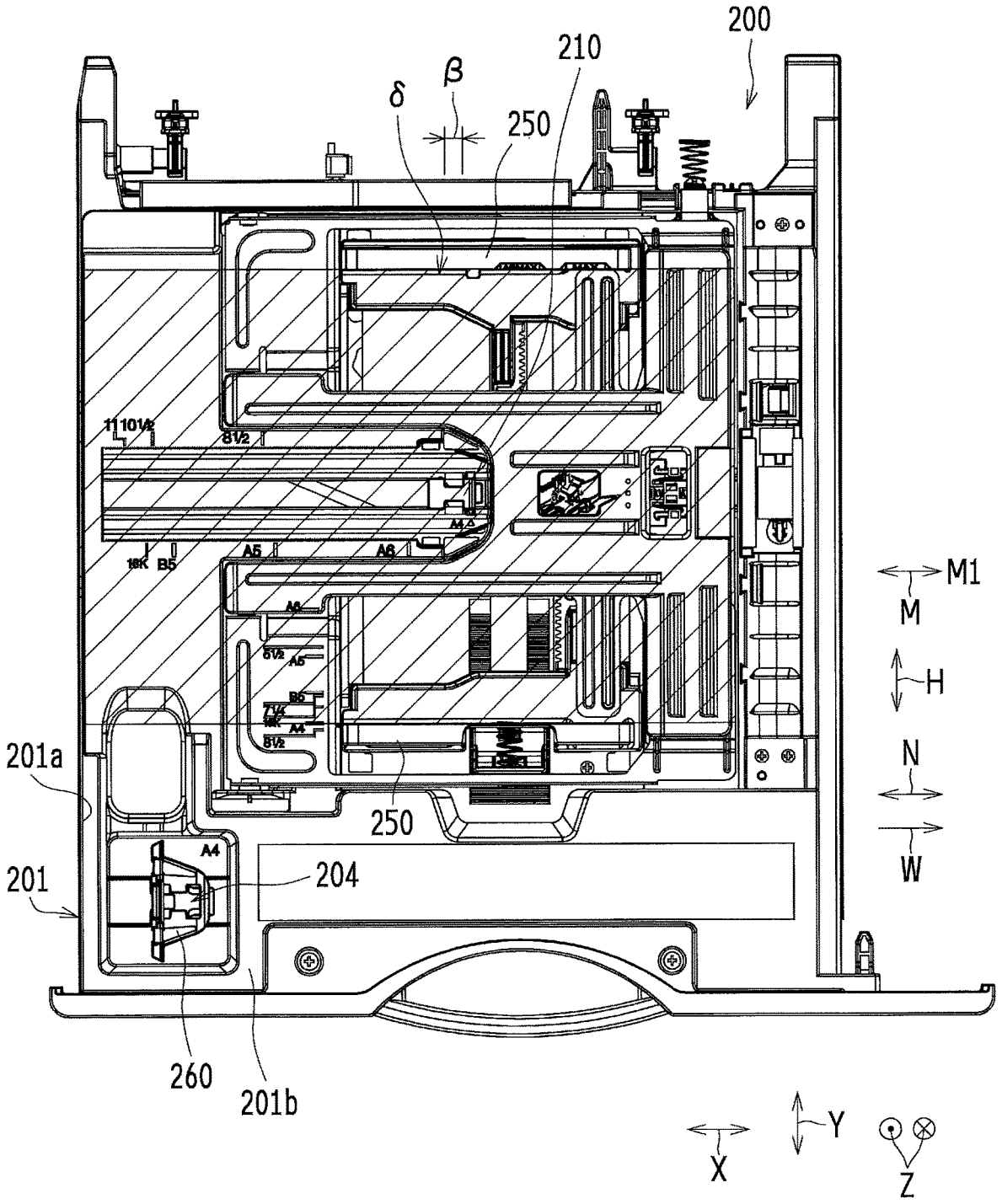
FIG. 16 is a schematic plan view planimetrically showing the sheet accommodating device in a case where sheets of a maximum accommodatable size are accommodated.

FIG. 16 is a schematic plan view planimetrically showing the sheet accommodating device 200 in a case where sheets of a maximum accommodatable size are accommodated. As shown in FIG. 16, the second embodiment is configured such that in case where sheets of the maximum accommodatable size (in this example, A4 size) are accommodated, a wall surface 201*a* of the housing 201 is utilized as the rear-end regulating member 260 with the rear-end regulating member 260 detached. This makes it possible to achieve downsizing of the sheet accommodating device 200.

More specifically, the wall surface 201*a* of the housing 201 on a rear-end side of the housing 201 is provided in such a position as to touch or come close to the rear ends of the sheets of the maximum accommodatable size (in this example, A4 size) when the sheets have been accommodated.

The controller 130 can recognize, from the states of detection of the detectors SW1, SW2, and SW3 of the size detecting device 230, the maximum accommodatable size (in this example, A4 size) of the sheets accommodated in the sheet accommodating device 200, with the wall surface 201*a* of the housing 201 being utilized as the rear-end regulating member 260 with the rear-end regulating member 260 detached from the moving member 210 when the moving member 210 is located in the attaching and detaching position β (i.e. when the detectors SW1, SW2, and SW3 are off, off, and on, respectively, in the aforementioned table). This allows the controller 130 to perform image processing according to the maximum accommodatable size of the sheets accommodated in the sheet accommodating device 200.

Third Embodiment

Figure 17A:
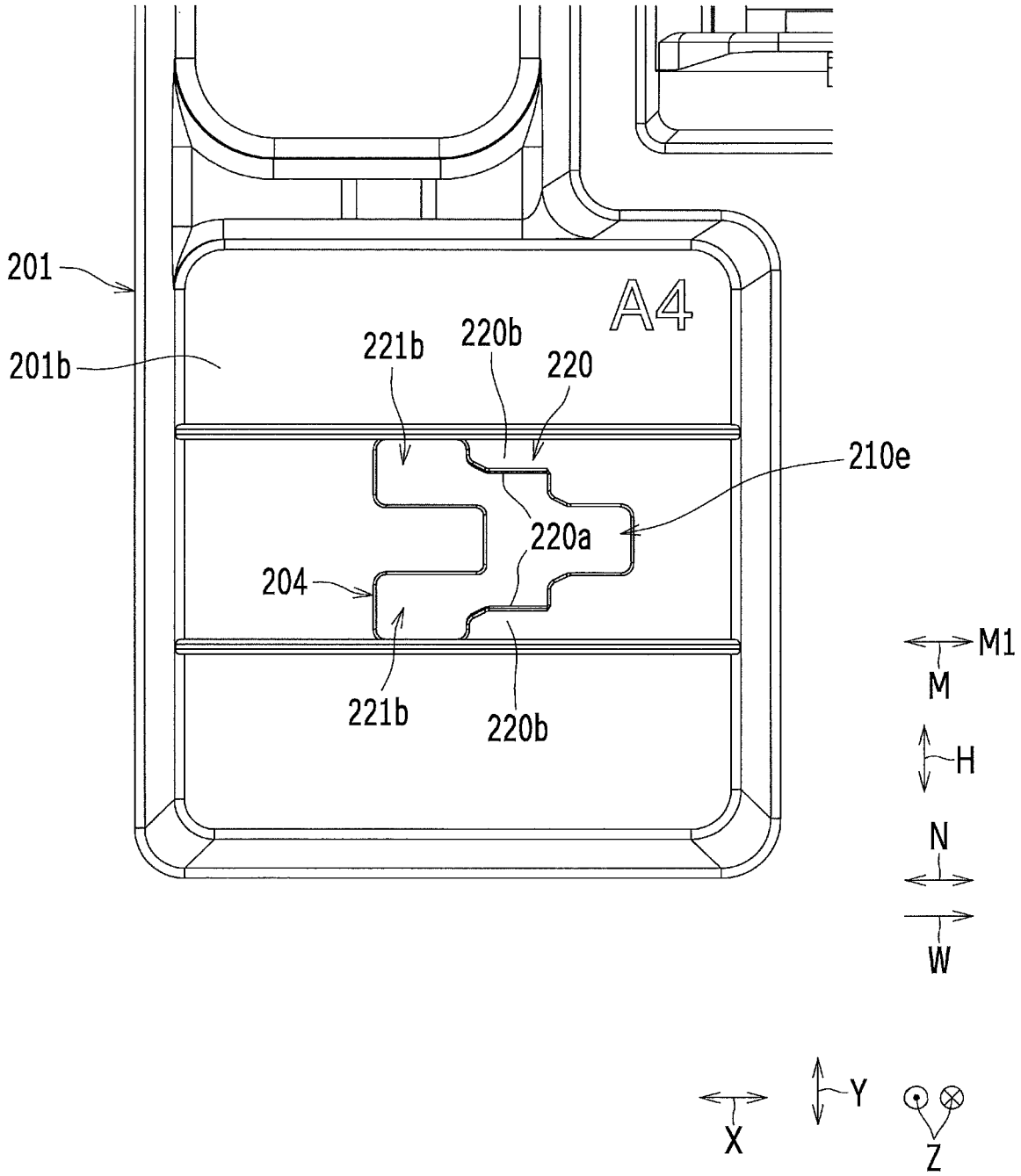
FIG. 17A is an enlarged plan view showing an attaching and detaching part provided outside a region of the housing where sheets are accommodated.
Figure 17B:
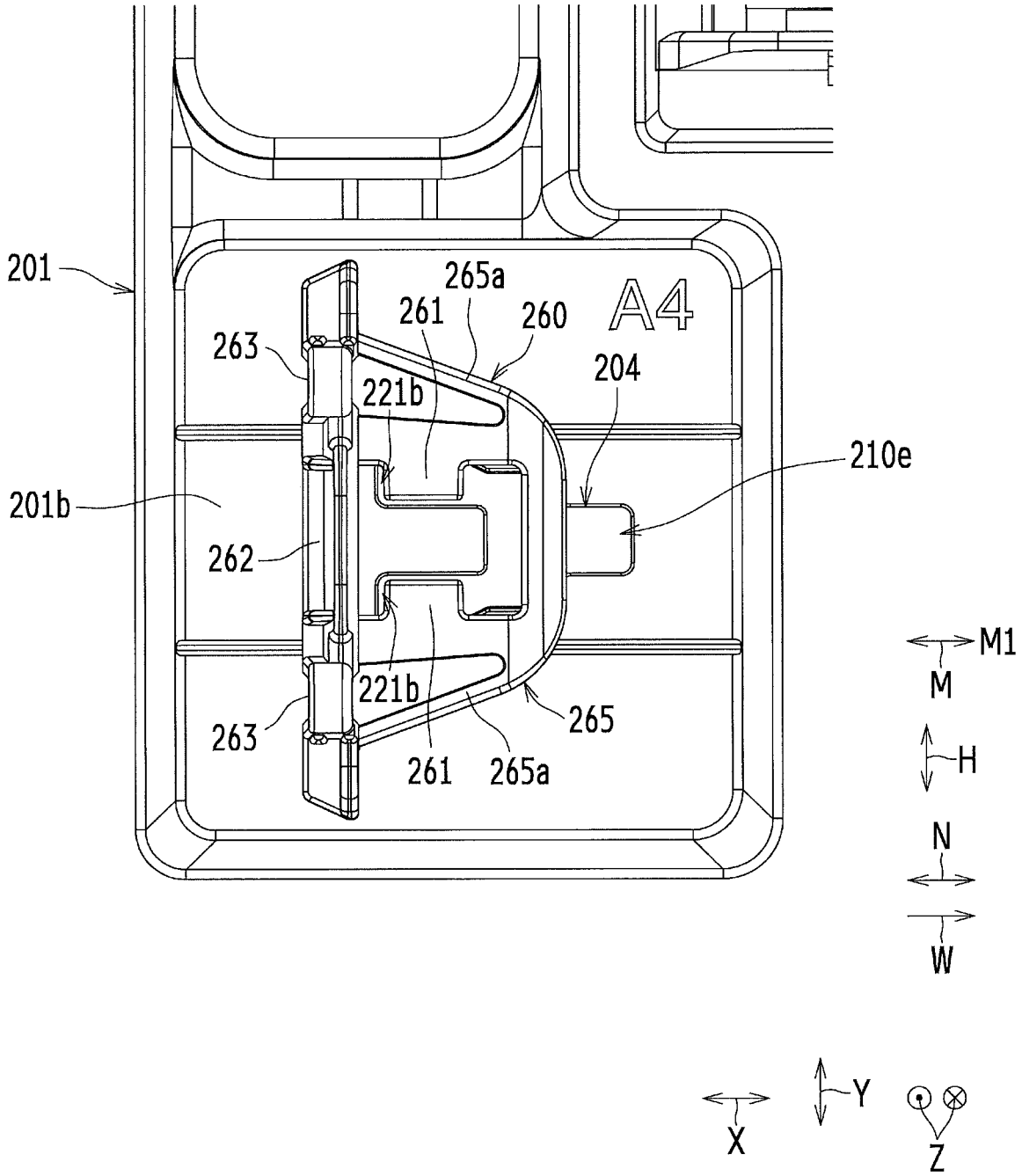
FIG. 17B is an enlarged plan view showing a state where the rear-end regulating member has been attached to the attaching and detaching part.
Figure 17C:
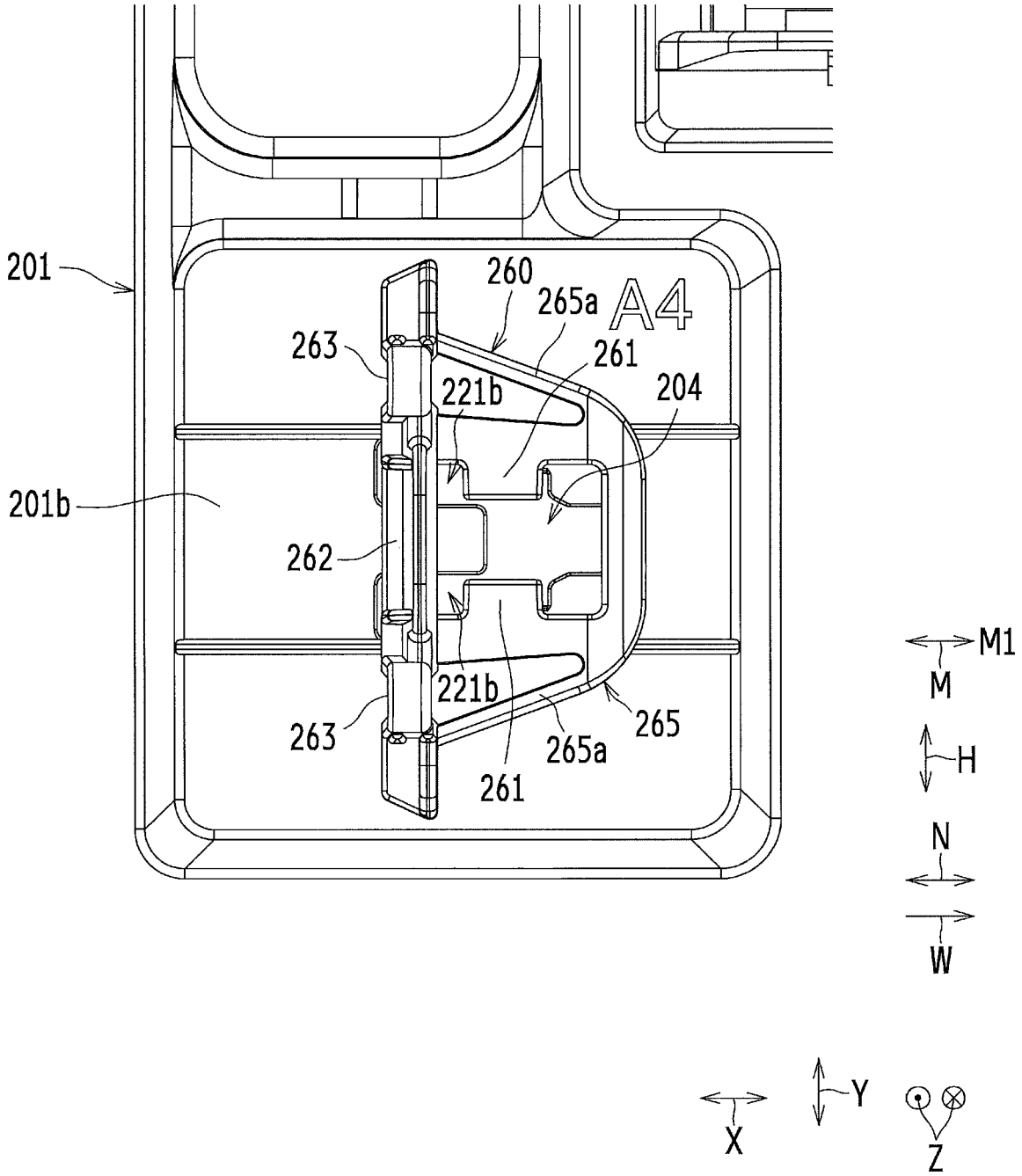
FIG. 17C is an enlarged plan view showing a state where the rear-end regulating member has been fixed to the attaching and detaching part.

FIG. 17A is an enlarged plan view showing an attaching and detaching part 204 provided outside a region δ of the housing 201 where sheets are accommodated. FIG. 17B is an enlarged plan view showing a state where the rear-end regulating member 260 has been attached to the attaching and detaching part 204. Further, FIG. 17C is an enlarged plan view showing a state where the rear-end regulating member 260 has been fixed to the attaching and detaching part 204. Components of the attaching and detaching part 204 shown in FIGS. 17A to 17C which are virtually identical to components of attachment and detachment in the attaching and detaching position β are given the same reference signs and, as such, are not described here.

The third embodiment is configured such that the attaching and detaching part 204, to and from which the rear-end regulating member 260 detached from the moving member 210 is attached and detached, is provided outside the region δ (see the shaded area of FIG. 16) of the housing 201 where sheets of a maximum accommodatable size are accommodated. The attaching and detaching part 204 has a configuration including components of attachment and detachment during the time when the moving member 210 is located in the attaching and detaching position β. This allows the rear-end regulating member 260 detached in the attaching and detaching position β to be attached to the attaching and detaching part 204 in the housing 201. This makes it possible to secure a space in which to stow the rear-end regulating member 260, and by extension to avoid losing the rear-end regulating member 260. Moreover, the attaching and detaching part 204 has a configuration including components of attachment and detachment during the time when the moving member 210 is located in the attaching and detaching position β. Accordingly, the operator can attach and detach the rear-end regulating member 260 to and from the attaching and detaching part 204 through an operation that is similar to the operation of attaching and detaching the rear-end regulating member 260 during the time when the moving member 210 is located in the attaching and detaching position β.

More specifically, the rear-end regulating member 260 is moved to the one side M1 of the direction of movement M with the sliders 261 fitted (see FIG. 17B) in the attaching and detaching holes 221*b* (see FIG. 17A) of the attaching and detaching part 204. In this way, the movement of the rear-end regulating member 260 along the width direction H and the vertical direction Z with respect to the attaching and detaching part 204 is regulated (fixed) (see FIG. 17C).

Figure 18:
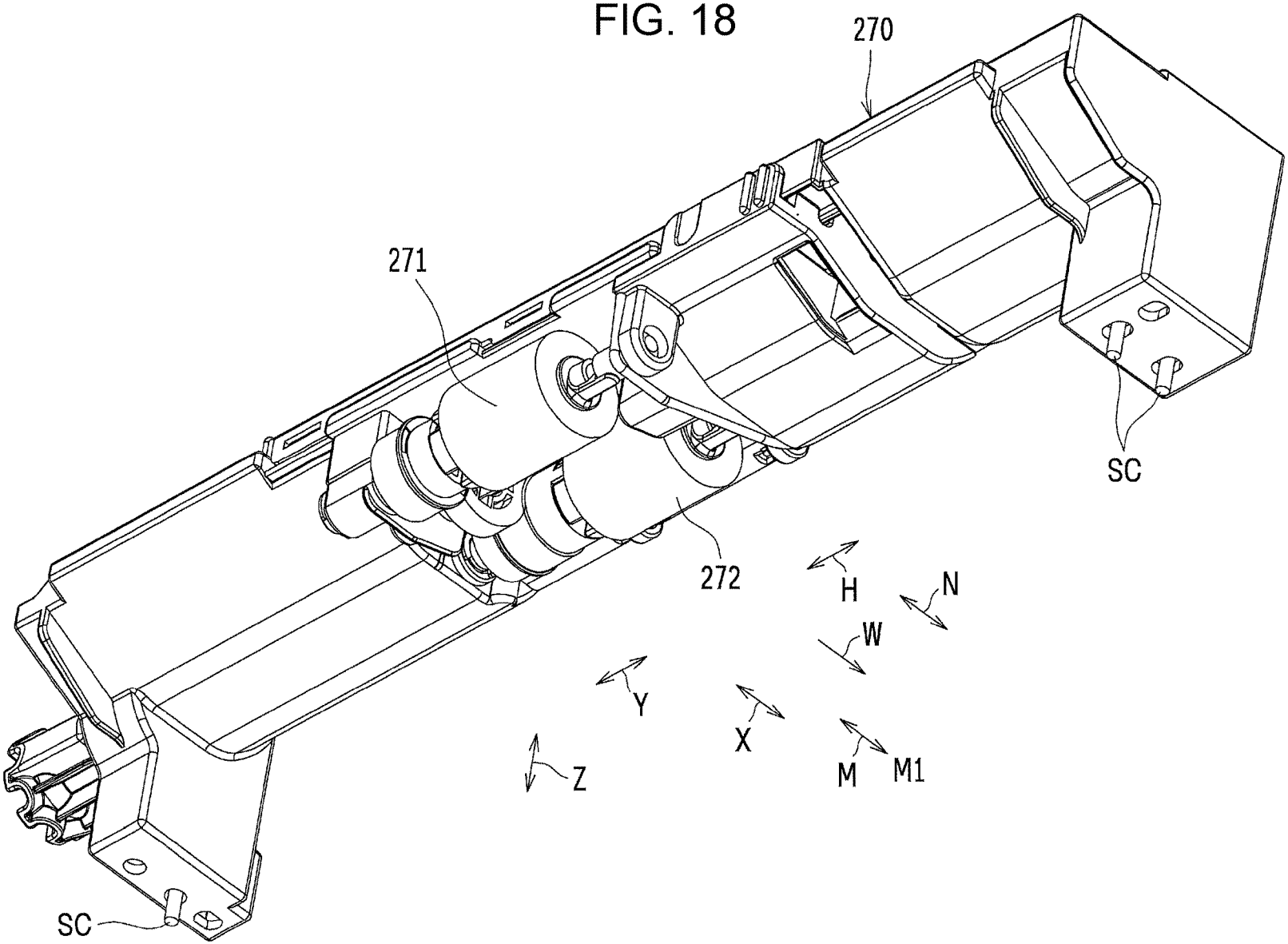
FIG. 18 is a schematic perspective view of the sheet feeding device as seen from obliquely below the front.

FIG. 18 is a schematic perspective view of the sheet feeding device 270 as seen from obliquely below the front. The third embodiment is configured such that the sheet accommodating device 200 includes the sheet feeding device 270 (see FIGS. 2 and 18) having the pickup roller 271 that feeds sheets one by one. Moreover, the sheet feeding device 270 is provided in the housing 201. This makes it possible to achieve compactification of the sheet accommodating device 200 including the sheet feeding device 270.

More specifically, the sheet feeding device 270 includes a sheet conveying member (or specifically, a sheet conveying roller 272) in addition to the pickup roller 271. Together with a separating member 280 (see FIG. 3) (or specifically, a separating roller), the sheet conveying roller 272 causes sheets pulled out by the pickup roller 271 to be fed one by one to the image forming apparatus body 110. The separating member 280 is provided in the housing 201. Moreover, the sheet feeding device 270 is fixed to the housing 201 by fixing members SC (see FIG. 18) such as screws (see FIG. 2). It should be noted that the configuration of the pickup roller 271, the sheet conveying roller 272, and the separating member 280 is similar to a conventionally publicly-known configuration and, as such, is not described in detail here.

Moreover, the sheet accommodating device 200 is provided in the image forming apparatus body 110 so as to be freely attached to and detached from the image forming apparatus body 110 by being slid along the width direction H.

OTHER EMBODIMENTS

Although the present embodiment is configured such that the regulating member is the rear-end regulating member 260, the regulating member may alternatively or additionally include the width regulating members 250.

The present disclosure is not limited to the embodiments described above but may be carried out in other various forms. Therefore, the embodiments are mere examples in all respects and should not be interpreted in a limited way. The scope of the present disclosure is indicated by the scope of the claims and is not bound in any way by the body of the specification. Furthermore, all modifications and alternations belonging to the equivalents of the scope of the claims are encompassed in the scope of the present disclosure.

The present disclosure contains subject matter related to that disclosed in Japanese Priority Patent Application JP 2017-212003 filed in the Japan Patent Office on Nov. 1, 2017, the entire contents of which are hereby incorporated by reference.

What is claimed is:

1. A sheet accommodating device comprising:

a regulating member that regulates end portions of sheets;

a moving member movably in a sheet feeding direction provided in a body of the sheet accommodating device, and a guide that guides the moving member movably provided in the body of the sheet accommodating device, wherein the regulating member is detachably provided on the moving member, and a moving region of the moving member includes a size regulation region where the end portions of the sheets are regulated and a predetermined non-size regulation region excluding the size regulation region, the sheet accommodating device being configured to permit the regulating member to be attached to and detached from the moving member in a predetermined attaching and detaching position of the non-size regulation region and prohibit the regulating member from being detached from the moving member in a detachment prohibition region of the moving region excluding the attaching and detaching position, wherein the guide comprising:

a first guide located at the detachment prohibition region, and a second guide located at the detaching position, wherein the first guide is connected to the second guide in the sheet feeding direction.

2. The sheet accommodating device according to claim 1, wherein a region where the sheets of a minimum accommodatable size are mounted is the non-size regulation region, and the attaching and detaching position is located within the region where the sheets of the minimum accommodatable size are mounted.

3. The sheet accommodating device according to claim 1, further comprising a detection mechanism that causes a size detecting device to detect a size of the sheets, wherein the moving member interlocks with the detection mechanism.

4. The sheet accommodating device according to claim 1, further comprising a slide regulator that regulates how the moving member slides when the moving member moves from the attaching and detaching position to the detachment prohibition region.

5. The sheet accommodating device according to claim 4, wherein the slide regulator is away from the attaching and detaching position toward away from the detachment prohibition region by a predetermined first moved distance.

6. The sheet accommodating device according to claim 4, wherein the body of the sheet accommodating device is provided with the guide that movably guides the moving member, the guide has a first raised portion provided on a side surface of the guide that faces the moving member, the moving member has a second raised portion, provided on a side surface of the moving member that faces the guide, which movement of the moving member causes to make slide contact with the first raised portion of the guide, and the first and second raised portions constitute the slide regulator.

7. The sheet accommodating device according to claim 1, wherein the body of the sheet accommodating device is provided with the guide that movably guides the moving member, the regulating member has a catching part provided as a part of the regulating member that faces the guide, and the guide is provided with a locking region where the catching part of the regulating member attached to the moving member is locked.

8. The sheet accommodating device according to claim 5, wherein the locking region is away from the attaching and detaching position toward the detachment prohibition region by a predetermined second moved distance.

9. The sheet accommodating device according to claim 1, wherein the regulating member and the moving member are provided with a slant prevention mechanism that prevents the regulating member from slanting.

10. The sheet accommodating device according to claim 1, wherein in a case where the sheets of a maximum accommodatable size are accommodated, a wall surface of the body of the sheet accommodating device is utilized to regulate end portions of the sheets with the regulating member detached.

11. The sheet accommodating device according to claim 10, further comprising an attaching and detaching part, provided outside a region of the body of the sheet accommodating device where the sheets are accommodated, to and from which the regulating member detached from the moving member is attached and detached, wherein the attaching and detaching part has a configuration including components of attachment and detachment during a time when the moving member is located in the attaching and detaching position.

12. The sheet accommodating device according to claim 1, further comprising a sheet feeding device having a sheet feeding member that feeds the sheets one by one, wherein the sheet feeding device is provided in the body of the sheet accommodating device.

13. An image forming apparatus comprising the sheet accommodating device according to claim 1.

* * * * *